US006611672B2

(12) United States Patent
Aoki et al.

(10) Patent No.: US 6,611,672 B2
(45) Date of Patent: Aug. 26, 2003

(54) IMAGE FORMING APPARATUS, MONOCOLOR IMAGE FORMING APPARATUS, TONER RECYCLING APPARATUS AND INTERMEDIATE TRANSFER MEMBER

(75) Inventors: Katsuhiro Aoki, Ohta-ku (JP); Tsumori Satoh, Ohta-ku (JP); Misao Tanzawa, Ohta-ku (JP); Yuuji Sawai, Ohta-ku (JP); Mitsuru Takahashi, Ohta-ku (JP); Hajime Oyama, Ohta-ku (JP); Sadayuki Iwai, Ohta-ku (JP); Tohru Nakano, Ohta-ku (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/960,922

(22) Filed: Sep. 25, 2001

(65) Prior Publication Data

US 2002/0051664 A1 May 2, 2002

(30) Foreign Application Priority Data

| | | |
|---|---|---|
| Sep. 26, 2000 | (JP) | 2000-291425 |
| Nov. 10, 2000 | (JP) | 2000-342971 |
| Jan. 9, 2001 | (JP) | 2001-000984 |
| Aug. 22, 2001 | (JP) | 2001-251211 |

(51) Int. Cl.[7] ..... G03G 21/10; G03G 15/01
(52) U.S. Cl. ..... 399/359; 399/302
(58) Field of Search ..... 399/101, 111, 399/297, 298, 299, 300, 302, 308, 358, 359

(56) References Cited

U.S. PATENT DOCUMENTS

| | | | | |
|---|---|---|---|---|
| 4,760,427 A | | 7/1988 | Oyama et al. | |
| 5,083,160 A | | 1/1992 | Suzuki et al. | |
| 5,328,795 A | * | 7/1994 | Yamashiro et al. | 430/110.3 X |
| 5,442,428 A | | 8/1995 | Takahashi et al. | |
| 5,574,558 A | | 11/1996 | Kudo et al. | |
| 5,697,031 A | | 12/1997 | Kamiya et al. | |
| 5,701,566 A | | 12/1997 | Bisaiji et al. | |
| 5,724,633 A | * | 3/1998 | Amemiya | 399/299 X |
| 5,729,024 A | | 3/1998 | Baba et al. | |
| 5,758,038 A | * | 5/1998 | Itoh et al. | 399/101 X |
| 5,774,770 A | * | 6/1998 | Hiroshi | 399/358 X |
| 5,781,841 A | * | 7/1998 | Kouroku et al. | 399/358 X |

(List continued on next page.)

FOREIGN PATENT DOCUMENTS

| | | |
|---|---|---|
| JP | 59-192159 | 12/1984 |
| JP | 01-282571 | 11/1989 |
| JP | 02-183276 | 7/1990 |
| JP | 04-147170 | 5/1992 |
| JP | 08-248708 | 9/1996 |
| JP | 09-034276 | 2/1997 |
| JP | 09-288397 | 11/1997 |
| JP | 10-078689 | 3/1998 |
| JP | 2000-206755 | 7/2000 |

*Primary Examiner*—Sandra Brase
(74) *Attorney, Agent, or Firm*—Oblon, Spivak, McClelland, Maier & Neustadt, P.C.

(57) ABSTRACT

Monocolor image forming unit includes a developing device and an image carrier cleaning device arranged around an image carrier. A plurality of such the monocolor image forming unit is arrayed laterally along the rotary transport direction of an intermediate transfer member of the belt type to configure a tandem image forming device. In the tandem image forming device, a synthesized toner image is formed on the intermediate transfer member and transferred to a recording medium to form a multicolor image thereon. Among the plurality of monocolor image forming unit contained in the tandem image forming device, at least two monocolor image forming unit each include a toner recycling device for conveying toner collected at the image carrier cleaning device to the developing device.

58 Claims, 13 Drawing Sheets

U.S. PATENT DOCUMENTS 5,809,388 A 9/1998 Inada et al.
5,818,062 A 10/1998 Baba et al.
5,864,737 A 1/1999 Obu et al.
5,870,650 A 2/1999 Takahashi et al.
5,913,092 A 6/1999 Bisaiji et al.
5,923,930 A 7/1999 Tsukamoto et al.
5,929,436 A 7/1999 Baba et al.
5,937,247 A 8/1999 Takeuchi et al.
5,946,525 A * 8/1999 Okamura et al. ..... 399/302 X
5,983,060 A 11/1999 Namekata et al.
5,987,281 A 11/1999 Kurotori et al.
5,999,779 A 12/1999 Takeuchi
6,006,062 A 12/1999 Takahashi et al.
6,031,633 A 2/2000 Andoh et al.
6,035,157 A 3/2000 Takahashi et al.
6,038,421 A 3/2000 Yoshino et al.
6,060,205 A * 5/2000 Takeichi et al. ..... 399/297 X
6,061,540 A 5/2000 Takeda
6,074,794 A 6/2000 Fushimi et al.
6,108,508 A 8/2000 Takeuchi et al.
6,115,576 A 9/2000 Nakano et al.
6,131,001 A 10/2000 Tsukamoto et al.
6,134,394 A 10/2000 Tsukamoto et al.
6,154,624 A 11/2000 Sasaki et al.
6,183,926 B1 2/2001 Kuroda et al.
6,212,351 B1 4/2001 Kawagoe et al.
6,223,008 B1 4/2001 Takahashi et al.
6,236,825 B1 5/2001 Takeuchi
6,252,682 B1 6/2001 Baba et al.
6,256,461 B1 7/2001 Takeyama et al.
6,258,502 B1 7/2001 Nakamura et al.
6,269,228 B1 7/2001 Kayahara et al.
6,292,641 B1 9/2001 Takeyama et al.
6,295,437 B1 9/2001 Hodoshima et al.
6,303,258 B1 10/2001 Katoh et al.
6,363,229 B1 3/2002 Shiraishi et al.
6,366,751 B1 4/2002 Shakuto et al.
6,374,070 B2 * 4/2002 Itoh ..... 399/128
6,385,423 B1 5/2002 Kai
6,405,002 B2 6/2002 Ogiyama et al.
6,405,008 B1 6/2002 Obu et al.
6,442,364 B2 8/2002 Kai et al.
6,445,900 B2 9/2002 Fukao et al.
6,449,452 B1 9/2002 Kai
6,449,453 B1 9/2002 Motohashi
6,456,806 B2 9/2002 Shoji et al.

* cited by examiner

FIG.25 RELATEDART
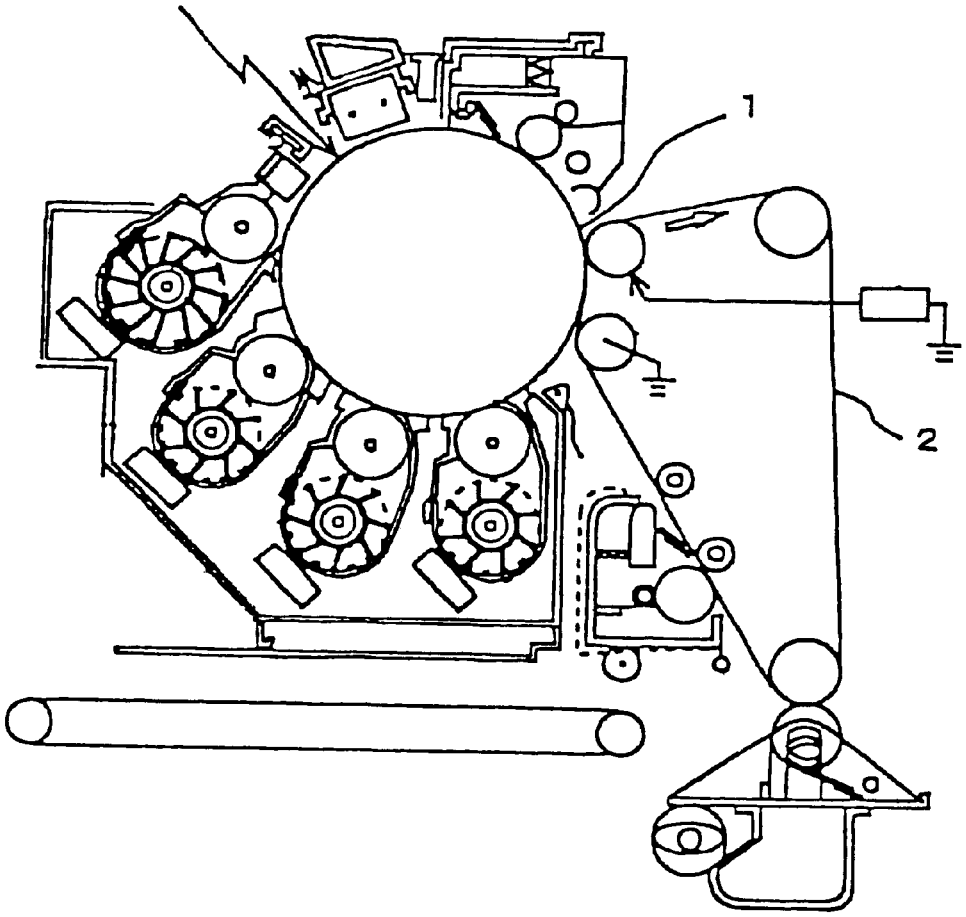

IMAGE FORMING APPARATUS, MONOCOLOR IMAGE FORMING APPARATUS, TONER RECYCLING APPARATUS AND INTERMEDIATE TRANSFER MEMBER

FIELD OF THE INVENTION

The present invention relates to an image forming apparatus such as a copier, a printer, a facsimile and a composite machine thereof. The apparatus employs a two- or single-component developer to form a toner image on an image carrier through sequential repeats of charging, writing, developing, transferring and cleaning and transfers the toner image via an intermediate transfer member to a recording medium to form a colored, two-color or monochromic image thereon. The present invention also relates to a monocolor image forming unit including a developing device and an image carrier cleaning device arranged around an image carrier in such the image forming apparatus. The present invention further relates to a toner recycling apparatus for conveying toner collected at the image carrier cleaning device to the developing device in such the monocolor image forming unit.

BACKGROUND OF THE INVENTION

Conventional image forming apparatus include a type of forming a monochromatic toner image and a type of forming a multicolored, two-color toner image or colored toner image both on a recording medium such as a sheet of paper and an OHP film.

The image forming apparatus for forming a monochromatic toner image comprises one monocolor image forming unit as disclosed in Japanese Patent Application Laid-Open No. 8-248708 publication, for example. The monocolor image forming unit generally includes a developing device and an image carrier cleaning device that are located around an image carrier. Thus configured monocolor image forming unit is employed to form a monochromatic toner image on an image carrier. The toner image is then transferred from the image carrier directly to a recording medium to form an image thereon.

The image forming apparatus for forming a multicolored toner image, on the other hand, includes a type of transferring a toner image formed on an image carrier directly to a recording medium to form an image thereon. It also includes another type of transferring a toner image formed on an image carrier once to an intermediate transfer member and then transferring the toner image from the intermediate transfer member to a recording medium to form an image thereon. Among such the arrangements for forming the multicolored toner image, the former is referred to as a direct transfer type and the latter an indirect transfer type.

The image forming apparatus of the direct transfer type comprises monocolor image forming unit as disclosed in Japanese Patent Application Laid-Open No. 9-288397 publication, for example. The monocolor image forming unit includes a developing device and an image carrier cleaning device that are located around an image carrier. A plurality of such the monocolor image forming unit is arrayed along the rotary transport direction of a recording medium to provide a tandem image forming apparatus. In the tandem image forming apparatus, individual monocolor image forming unit form respective monocolor toner images, which are then transferred from individual image carriers directly to the recording medium to form a synthesized toner image thereon.

The latter image forming apparatus of the indirect transfer type employs a rotary developing device for the monocolor image forming unit as described in the above publication to form monocolor toner images sequentially on an image carrier. Thereafter, the formed monochromic toner images are transferred in turn to an intermediate transfer member to form a synthesized toner image, which is then transferred to a recording medium to form a multicolored image thereon.

Another image forming apparatus in the art has an arrangement to apply a substance for reducing a coefficient of friction on the surface of an intermediate transfer member, as disclosed in Japanese Patent Application Laid-Open No. 9-34276 publication, for example. This arrangement can achieve an increased release property between the surface of the intermediate transfer member and the toner, an improved transfer rate and a reduced cleaning load, and consequently it can prevent an after-image from occurring.

Recently, mass colored documents are handled even in an office and accordingly faster full-color printers and full-color copiers are desired increasingly more than before. A recent widespread color laser printer generally comprise a plurality of developing devices arranged touchable with one image carrier or the so-called photosensitive material. Each of different colored toner images is formed per revolution of the photosensitive material and the images are transferred in turn from the photosensitive material to an intermediate transfer member or a recording paper held on a transfer drum and the like to form a color toner image. This is the so-called one-drum type of mainstream. Among those, the intermediate transfer type as described above superimposes multicolored toner images on the intermediate transfer member and then integrally transfers them to a recording paper. To the contrary, the direct transfer type transfers them in turn to a recording paper held on the transfer drum, for example, to form a colored toner image. The direct transfer type, though it can be realized with a simple structure and low cost, is difficult to form a stable image because plural transfers to the recording paper require different conditions that depends on resistances and water contents of the recording paper. The intermediate transfer type is characterized by stability of image quality and adaptability to paper types because the image transfer to the recording paper is required only once.

To obtain a colored image with four colors, any one of the above machines is required to rotate the photosensitive material four times and therefore difficult to achieve a higher yield. To achieve a high-speed performance, through the use of increased photosensitive materials corresponding to the number of colors, and arrangement of the same number of developing devices corresponding to the photosensitive materials, a recording paper can continuously contact the photosensitive materials to obtain a colored image. This is a machine of the so-called tandem type or inline type and is commercially available. In this case, if the outer circumferential surface has a velocity equal to that of the photosensitive material in the one-drum type, it is possible to print with a speed four times higher or more than that of the one-drum type. As described above, the direct transfer type that directly transfers from the photosensitive material to the recording paper, however, cause many problems that include instability during the transfer to the recording paper and positioning during the transport of the recording paper. The so-called tandem intermediate transfer type, which employs an intermediate transfer member in a tandem system, has been proposed as is disclosed in Japanese Patent Application Laid-Open No. 59-192159 publication, for example.

FIG. 25 shows an arrangement example of the conventional one-drum intermediate transfer type that employs an intermediate transfer belt as the intermediate transfer member. In this example, there is only one transfer portion to transfer from a photosensitive material 1 to an intermediate transfer belt 3. In general, the outer circumference of the intermediate transfer belt is required to have a length at least equal to the length of a recording paper to print. Accordingly, a certain time is required for transferring an image of a second color at the same transfer portion after an image of a first color is transferred to the intermediate transfer belt 3. Therefore, if a material with a relatively higher volume resistance is employed for the intermediate transfer belt 3 and even the intermediate transfer belt 3 is charged during the transfer, there is a time margin to release the charge before a transfer is performed again.

On the other hand, in contrast to the one-drum intermediate transfer type, the tandem intermediate transfer type comprises a plurality of photosensitive materials arranged around the outer circumference of one intermediate transfer belt and a plurality of transfer portions for transferring images from the plurality of photosensitive materials. A gap between adjacent transfer portions is restricted mainly from mechanical dimensional limitations. In general, the gap between the transfer portions is set as narrow as possible so that the machine can be designed compact. Therefore, after a primary transfer from the photosensitive material to the intermediate transfer belt is performed, a time to perform a secondary transfer can be shortened. In this case, there is no time margin to release the charge generated during the primary transfer. Accordingly, the charge remaining on the surface of the intermediate transfer belt inhibits the secondary transfer. Therefore, a higher electric field is required to transfer a toner image in a good condition.

Potentials of latent images on the photosensitive material affect on the primary transfer and cause residual potential variations that reflect the potential differences. The potential variations may cause transfer variations when a solid image is transferred with a second color on the intermediate transfer belt because on the intermediate transfer belt an image-transferred portion has a transfer efficiency lower than that of a non-transferred portion. The potential variations may also produce transfer dispersions (toner scattering). The transfer dispersion unit a phenomenon that blurs an image, when a toner image is primarily transferred from the photosensitive material to the intermediate transfer belt, as a result of dispersions of the toner image that is not transferred to a correct location but dispersed to periphery thereof. Thus, the image loses its sharpness, particularly at thin line parts.

Technologies for preventing the transfer dispersions from occurring have been known. For example, Japanese Patent Application Laid-Open No. 1-282571 publication discloses a technology that erases the charges from transferred toner images by a paper-peeling charger each time a toner image is transferred to an intermediate transfer member. Japanese Patent Application Laid-Open No. 2-183276 publication discloses a technology that sets a transfer voltage at the final transfer stage higher than that at an immediately previous one and applies a certain voltage to an intermediate transfer member during a shift to each transfer stage. Japanese Patent Application Laid-Open No. 4-147170 publication discloses a technology that erases the charges from an intermediate transfer belt before transferring a toner image from the intermediate transfer member to a recording paper. Technologies disclosed in these Japanese Patent Application Laid-Open No. 1-282571, Japanese Patent Application Laid-Open No. 2-183276 and Japanese Patent Application Laid-Open No. 4-147170 publications are disadvantageous, however, because they need unit for erasing charges and unit for applying voltages as well as control unit for controlling these unit, complicating control mechanisms and preventing the devices from being down-sized.

In consideration of the above disadvantages, an application has been filed as is shown in Japanese Patent Application Laid-Open No. 10-78689 publication, which defines a length, moving speed, permittivity and volume resistivity of an intermediate transfer belt in one-drum mediate transfer system. This application, however, does not provide a consideration in the tandem intermediate transfer type.

In view of recent ecology, it is strongly desired to maintain social environments and reduce consumption of resources. Accordingly, it is publicly desired to recycle the toner for use in an image forming apparatus increasingly. The use of the recycled toner can substantially reduce an amount of toner consumption and lower a cost for maintenance.

From the above reasons, the above-described conventional image forming apparatus increasingly tends to provide the monocolor image forming unit with a toner recycling device for conveying toner collected at the image carrier cleaning device to the developing device.

In the image forming apparatus of the direct transfer type, however, even if it is either the type of forming a monochromic toner image or the type of forming a multicolor toner image, the image carrier directly contacts a recording medium. Therefore, foreign matters such as paper powders and dusts attached to the recording medium may transfer to the image carrier and the transferred foreign matters are often mixed into the toner collected at the image carrier cleaning device. The use of the toner mixed with foreign matters possibly degrades an image quality.

The image forming apparatus of the indirect transfer type, of which an image carrier does not contact directly with a recording medium, has no problem regarding the mixture of foreign matters. If the conventional configuration disclosed in Japanese Patent Application Laid-Open No. 9-288397 publication intends to recycle individual toner of each color, however, it must install image carrier cleaning devices dedicated to respective colors and mechanisms for contacting and separating the image carrier cleaning devices to and from the image carrier. Installation of such the mechanisms complicates the configuration of the image forming apparatus and therefore has a difficulty on realization.

Accordingly, the configuration, disclosed in Japanese Patent Application Laid-Open No. 9-288397 publication, is directed to recycle the black toner only.

In the image forming apparatus that prevents an after-image from occurring, for example, as shown in FIG. 24, it comprises four photosensitive materials 1 that are arranged in line to form individual monocolor toner images thereon. These toner images are sequentially transferred to an intermediate transfer member 3 by means of each of primary transfer devices 2. The image on the intermediate transfer member 3 is integrally transferred by means of a secondary transfer device 4 to a sheet s to record the image thereon. This is the so-called tandem image forming apparatus of the indirect transfer type.

Such the image forming apparatus sequentially performs transfers to the intermediate transfer member 3 in a four-time superimposing mode. Therefore, after the image transfer by the secondary transfer device 4, if an intermediate transfer member cleaning device 5 cleans the intermediate transfer member 3 on a surface, the surface can not be cleaned clearly and remains an after-image. This is a problem.

To solve the above problem, if a force to press a cleaning blade 6 of the intermediate transfer member cleaning device 5 against the intermediate transfer member 3 is increased, its surface can be degraded. This is another problem.

In the tandem intermediate transfer type, such an image forming apparatus has not been proposed, that can define the length, moving speed, permittivity and volume resistivity of the intermediate transfer belt to form an image in good condition with less transfer dispersion and low cost. This is a further problem.

SUMMARY OF THE INVENTION

A first object of the present invention is, in an image forming apparatus for forming a synthesized toner image, to prevent foreign matters from mixing into recycled toner in order to prevent an image quality from lowering and allow the recycled use of the individual toner.

A second object is, in a color image forming apparatus, to achieve the first object.

A third object is, in a color image forming apparatus, to make the best use of recycled toner that has no possibility of color-mixture.

A fourth object is, in an image forming apparatus for forming a synthesized toner image, to allow the use of recycled black toner that has less image degradation while preventing foreign matters from mixing into the recycled toner.

A fifth object is, in a color image forming apparatus, to prevent toner from degrading even if toner of different colors are mixed.

A sixth object is, in a two-color image forming apparatus, to achieve the fifth object.

A seventh object is, in a multicolor image forming apparatus with an image carrier of the drum type and an intermediate transfer member of the belt type, to achieve the first object.

An eighth object is, in a multicolor image forming apparatus with an image carrier and an intermediate transfer member both of the belt types, to achieve the first object.

A ninth object is, in an image forming apparatus for forming a synthesized toner image, to achieve the first object while improving the maintenance property.

A tenth object is, in monocolor image forming unit for use in an image forming apparatus for forming a synthesized toner image, to prevent foreign matters from mixing into recycled toner in order to prevent an image quality from lowering and allow the recycled use of individual toner.

An eleventh object is, in a toner recycling apparatus for use in an image forming apparatus for forming a synthesized toner image, to prevent foreign matters from mixing into recycled toner in order to prevent an image quality from lowering and allow the recycled use of individual toner.

A twelfth object is, in an image forming apparatus for forming a monocolor toner image, to prevent foreign matters from mixing into recycled toner in order to prevent an image quality from lowering and allow the recycled use of individual toner.

A thirteenth object is, in a monocolor image forming apparatus with an image carrier of the drum type and an intermediate transfer member of the belt or drum type, to achieve the twelfth object.

A fourteenth object is, in a monocolor image forming apparatus with an image carrier of the belt type and an intermediate transfer member of the belt or drum type, to achieve the twelfth object.

A fifteenth object is, in a monocolor image forming apparatus, to achieve the twelfth object while increasing the maintenance property.

A sixteenth object is, in monocolor image forming unit for use in a monocolor image forming apparatus, to prevent foreign matters from mixing into recycled toner in order to prevent an image quality from lowering and allow the recycled use of individual toner.

A seventeenth object is, in a toner recycling apparatus for use in a monocolor image forming apparatus, to prevent foreign matters from mixing into recycled toner in order to prevent an image quality from lowering and allow the recycled use of individual toner.

An eighteenth object is, in an image forming apparatus, to additionally prevent uncharged or insufficiently charged impurities from attaching to an image carrier in order to further prevent an image quality from lowering.

A nineteenth object is, in an image forming apparatus, to further prevent toner from being fractured frictionally in order to further prevent an image quality from lowering.

A twentieth object is, in an image forming apparatus, to further smoothen the surface feature of toner to improve a transfer rate of the toner and reduce an amount of recycled toner, thereby preventing an image quality from degrading in order to further prevent the image quality from lowering.

A twenty-first object is, in an image forming apparatus, to additionally eliminate variations in a component ratio of toner at the time of toner recycling, thereby preventing an image quality from degrading in order to further prevent the image quality from lowering.

A twenty-second object is, in an image forming apparatus, to further contact an intermediate transfer member tightly with an image carrier to improve a transfer rate of toner in order to further prevent an image quality from lowering.

A twenty-third object is to improve a cleaning performance in order to achieve the first or twelfth object while preventing an after-image from occurring without degradation of a surface of an intermediate transfer member.

A twenty-fourth object is to reduce a toner adhesion to an intermediate transfer member to improve a cleaning performance in order to achieve the first or twelfth object while preventing an after-image from occurring.

A twenty-fifth object is to increase a release property between a surface of an intermediate transfer member and toner to improve a cleaning performance in order to achieve the first or twelfth object while preventing an after-image from occurring.

A twenty-sixth object is to facilitate an increase to occur in a cleaning performance in order to achieve the first or twelfth object while easily preventing an after-image from occurring without degradation of a surface of an intermediate transfer member.

A twenty-seventh object is to define a length, surface moving speed, permittivity and volume resistivity of an intermediate transfer member in order to achieve the first or twelfth object while reducing transfer dispersions with low cost.

A twenty-eighth object of the present invention is to improve a cleaning performance in order to prevent an after-image from occurring without degradation of a surface of an intermediate transfer member.

A twenty-ninth object is to reduce a toner adhesion to an intermediate transfer member to improve a cleaning performance in order to prevent an after-image from occurring.

A thirtieth object is to increase a release property between a surface of an intermediate transfer member and toner to improve a cleaning performance in order to prevent an after-image from occurring.

A thirty-first object is to provide an image forming apparatus comprising an intermediate transfer member that can achieve the above objects.

A thirty-second object is to provide an image forming apparatus capable of facilitating an increase to occur in a cleaning performance in order to easily prevent an after-image from occurring without degradation of a surface of an intermediate transfer member.

A thirty-third object is to provide an image forming apparatus capable of further improving a cleaning performance in order to prevent an after-image from occurring without degradation of a surface of an intermediate transfer member.

A thirty-fourth object is to define a length, moving speed, permittivity and volume resistivity of an intermediate transfer member in a tandem intermediate transfer type in order to provide an image forming apparatus capable of obtaining an image in a good condition with less transfer dispersions and low cost.

To achieve the above objects, a first aspect of the present invention provides an image forming apparatus, comprising monocolor image forming unit including a developing device and an image carrier cleaning device arranged around an image carrier, for transferring a toner image formed on the image carrier in the monocolor image forming unit once to an intermediate transfer member then transferring the toner image from the intermediate transfer member to a recording medium to form an image thereon, wherein a plurality of the monocolor image forming unit is arrayed along the rotary transport direction of the intermediate transfer member to configure a tandem image forming device for forming a multicolor image on the intermediate transfer member, and wherein among the plurality of monocolor image forming unit contained in the tandem image forming device at least two monocolor image forming unit each include a toner recycling device for conveying toner collected at the image carrier cleaning device to the developing device.

To achieve the second object, a second aspect of the present invention provides the image forming apparatus according to the first aspect, wherein monocolor images formed by the respective monocolor image forming unit are synthesized via the intermediate transfer member to form a synthesized color image on the recording medium.

To achieve the third object, a third aspect of the present invention provides the image forming apparatus according to the second aspect, wherein in the tandem image forming device the monocolor image forming unit located upstream-most in the rotary transport direction of the intermediate transfer member includes the toner recycling device.

To achieve the fourth object, a fourth aspect of the present invention provides the image forming apparatus according to the second aspect, wherein among the plurality of monocolor image forming unit at least a black monocolor image forming unit includes the toner recycling device.

To achieve the fifth object, a fifth aspect of the present invention provides the image forming apparatus according to the second aspect, wherein in the tandem image forming device a black monocolor image forming unit is located downstream-most in the rotary transport direction of the intermediate transfer member.

To achieve the sixth object, a sixth aspect of the present invention provides the image forming apparatus according to the first aspect, wherein two monocolor image forming unit are arrayed along the rotary transport direction of the intermediate transfer member to form a two-color image on the recording medium by synthesizing via the intermediate transfer member two monocolor images formed at the two arrayed monocolor image forming unit.

To achieve the seventh object, a seventh aspect of the present invention provides the image forming apparatus according to any one of the first to sixth aspect wherein the image carrier comprises a drum and the intermediate transfer member comprises a belt.

To achieve the eighth object, an eighth aspect of the present invention provides the image forming apparatus according to any one of the first to sixth aspects, wherein the image carrier and the intermediate transfer member both comprise respective belts.

To achieve the ninth object, a ninth aspect of the present invention provides the image forming apparatus according to any one of the first to sixth aspects, further comprising a process cartridge integrally attached to and detached from a body of the image forming apparatus, wherein the process cartridge includes at least the image carrier.

To achieve the tenth object, a tenth aspect of the present invention provides a monocolor image forming apparatus, comprising monocolor image forming unit including a developing device and an image carrier cleaning device arranged around an image carrier, for use in an image forming apparatus for transferring a toner image formed on the image carrier once to an intermediate transfer member then transferring the toner image from the intermediate transfer member to a recording medium to form an image thereon, wherein a plurality of the monocolor image forming unit is arrayed along the rotary transport direction of the intermediate transfer member to configure a tandem image forming device for forming a multicolor image on the intermediate transfer member, and wherein among the plurality of arrayed monocolor image forming unit at least two monocolor image forming unit each include a toner recycling device for conveying toner collected at the image carrier cleaning device to the developing device.

To achieve the eleventh object, an eleventh aspect of the present invention provides a toner recycling apparatus, for use in an image forming apparatus comprising monocolor image forming unit including a developing device and an image carrier cleaning device arranged around an image carrier for transferring a toner image formed on the image carrier in the monocolor image forming unit once to an intermediate transfer member then transferring the toner image from the intermediate transfer member to a recording medium to form an image thereon, wherein a plurality of the monocolor image forming unit is arrayed along the rotary transport direction of the intermediate transfer member to configure a tandem image forming device for forming a multicolor image on the intermediate transfer member, and wherein among the plurality of arrayed monocolor image forming unit at least two monocolor image forming unit each include the toner recycling apparatus for conveying toner collected at the image carrier cleaning device to the developing device.

To achieve the twelfth object, a twelfth aspect of the present invention provides an image forming apparatus, comprising monocolor image forming unit including a developing device and an image carrier cleaning device arranged around an image carrier, for transferring a toner image formed on the image carrier in the monocolor image forming unit once to an intermediate transfer member then transferring the toner image from the intermediate transfer member to a recording medium to form an image thereon, wherein one monocolor image forming unit for forming a monochromic image on the intermediate transfer member is provided around the intermediate transfer member, and wherein the one monocolor image forming unit is provided with a toner recycling device for conveying toner collected at the image carrier cleaning device to the developing device.

To achieve the thirteenth object, a thirteenth aspect of the present invention provides the image forming apparatus according to the twelfth aspect, wherein the image carrier comprises a drum and the intermediate transfer member comprises a belt or drum.

To achieve the fourteenth object, a fourteenth aspect of the present invention provides the image forming apparatus according to the twelfth aspect, wherein the image carrier comprises a belt and the intermediate transfer member comprises a belt or drum.

To achieve the fifteenth object, a fifteenth aspect of the present invention provides the image forming apparatus according to the twelfth aspect, further comprising a process cartridge integrally attached to and detached from a body of the image forming apparatus, wherein the process cartridge includes at least the image carrier.

To achieve the sixteenth object, a sixteenth aspect of the present invention provides a monocolor image forming apparatus, comprising monocolor image forming unit including a developing device and an image carrier cleaning device arranged around an image carrier, for use in an image forming apparatus for transferring a toner image formed on the image carrier once to an intermediate transfer member then transferring the toner image from the intermediate transfer member to a recording medium to form an image thereon, wherein one monocolor image forming unit for forming a monochromic image on the intermediate transfer member is provided around the intermediate transfer member, and wherein the one monocolor image forming unit is provided with a toner recycling device for conveying toner collected at the image carrier cleaning device to the developing device.

To achieve the seventeenth object, a seventeenth aspect of the present invention provides a toner recycling apparatus, for use in an image forming apparatus comprising monocolor image forming unit including a developing device and an image carrier cleaning device arranged around an image carrier for transferring a toner image formed on the image carrier in the monocolor image forming unit once to an intermediate transfer member then transferring the toner image from the intermediate transfer member to a recording medium to form an image thereon, wherein one monocolor image forming unit for forming a monochromic image on the intermediate transfer member is provided around the intermediate transfer member, and wherein the one monocolor image forming unit is provided with the toner recycling apparatus for conveying toner collected at the image carrier cleaning device to the developing device.

To achieve the eighteenth object, an eighteenth aspect of the present invention provides the image forming apparatus according to the first to twelfth aspects, wherein the image forming apparatus applies a developing bias voltage on the developing device to generate an alternative electric field at the time of development.

To achieve the nineteenth object, a nineteenth aspect of the present invention provides the image forming apparatus according to the first to twelfth aspects, wherein the image forming apparatus employs toner which contains a release agent.

To achieve the twentieth object, a twentieth aspect of the present invention provides the image forming apparatus according to the first to twelfth aspects, wherein the image forming apparatus employs toner with a roundness of 90 or more.

To achieve the twenty-first object, A twenty-first aspect of the present invention provides the image forming apparatus according to the first to twelfth aspect, wherein the image forming apparatus employs toner having a half-value width of 2.2 [fC/10 $\mu$m] or less in a distribution curve of (toner charge)/(toner particle diameter).

To achieve the twenty-second object, a twenty-second aspect of the present invention provides the image forming apparatus according to the first to twelfth aspects, wherein the intermediate transfer member includes an elastic layer.

To achieve the twenty-third object, a twenty-third aspect of the present invention provides the image forming apparatus according to the first or twelfth, wherein the intermediate transfer member includes a toner adhesion reduction layer for reducing an adhesion of toner uniformly formed over a surface thereof.

To achieve the twenty-fourth object, a twenty-fourth aspect of the present invention provides the image forming apparatus according to the twenty-third aspect, wherein the toner adhesion reduction layer is composed of zinc stearate.

To achieve the twenty-fifth object, a twenty-fifth aspect of the present invention provides the image forming apparatus according to twenty-third aspect, wherein the toner adhesion reduction layer is composed of fluororesin.

To achieve the twenty-sixth object, a twenty-sixth aspect of the present invention provides the image forming apparatus according to the twenty-third aspect, wherein the toner adhesion reduction layer is composed of particles scraped off a block of bound particles using a brush and adhered to the intermediate transfer member.

To achieve the twenty-seventh object, a twenty-seventh aspect of the present invention provides the image forming apparatus according to the first or twelfth aspect, wherein the following relation is satisfied:

$$L_0/V_L > \rho_V \cdot \epsilon \cdot \epsilon_0$$

where $L_0$ denotes a distance in the rotary transport direction of the intermediate transfer member between a location of a charge given to a surface of the intermediate transfer member and a location of toner moved from the image carrier to the surface of the intermediate transfer member; $V_L$, $\rho_V$ and $\epsilon$ respectively denote a surface moving velocity, volume resistivity and relative permittivity of the intermediate transfer member; and $\epsilon_0$ denotes the vacuum permittivity.

To achieve the twenty-seventh object, a twenty-eighth aspect of the present invention provides the image forming apparatus according to the first to twelfth aspects, wherein the following relation is satisfied:

$$L_1/V_L > \rho_V \cdot \epsilon \cdot \epsilon_0$$

where $L_1$ denotes the shortest distance in the rotary transport direction of the intermediate transfer member among distances between adjacent primary transfer locations, the primary transfer location being defined as a location on the intermediate transfer member to which the toner image on the image carrier to be transferred; $V_L$, $\rho_V$ and $\epsilon$ respectively denote a surface moving velocity, volume resistivity and relative permittivity of the intermediate transfer member; and $\epsilon_0$ denotes the vacuum permittivity.

To achieve the twenty-seventh object, a twenty-ninth aspect of the present invention provides the image forming apparatus according to the twenty-seventh, wherein the following relation is satisfied:

$$L_2/V_L>\rho_V\cdot\epsilon\cdot\epsilon_0$$

where $L_2$ denotes a distance of an image carrier located downstream-most among the image carriers in the rotary transport direction of the intermediate transfer member between a primary transfer location and a secondary transfer location, the primary transfer location being defined as a location on the intermediate transfer member to which the toner image on the image carrier to be transferred, the secondary transfer location being defined as a location on the recording medium to which the toner image on the intermediate transfer member to be transferred.

To achieve the twenty-seventh object, a thirties aspect of the present invention provides the image forming apparatus according to the twenty-seventh aspect, wherein the following relation is satisfied:

$$L_3/V_L>\rho_V\cdot\epsilon\cdot\epsilon_0$$

where $L_3$ denotes a distance in the rotary transport direction of the intermediate transfer member between a secondary transfer location and an intermediate transfer member cleaning location, the secondary transfer location being defined as a location on the recording medium to which the toner image on the intermediate transfer member to be transferred, the intermediate transfer member cleaning location being defined as a location at which, after the transfer performed at the secondary transfer location, residual toner on the intermediate transfer member to be removed by an intermediate transfer member cleaning device.

To achieve the twenty-seventh object, a thirty-first aspect of the present invention provides the image forming apparatus according to the twenty-seventh, wherein the following relation is satisfied:

$$L_4/V_L>\rho_V\cdot\epsilon\cdot\epsilon_0$$

where $L_4$ denotes a distance of an image carrier located upstream-most among the image carriers in the rotary transport direction of the intermediate transfer member between a primary transfer location and an intermediate transfer member cleaning location, the primary transfer location being defined as a location on the intermediate transfer member to which the toner image on the image carrier to be transferred, the intermediate transfer member cleaning location being defined as a location at which, after the toner image on the intermediate transfer member transferred to the recording medium, residual toner on the intermediate transfer member to be removed by an intermediate transfer member cleaning device.

To achieve the twenty-eighth object, a thirty-second aspect of the present invention provides an intermediate transfer member for use in a xerography apparatus for transferring a toner image formed on an image carrier once to a surface of the intermediate transfer member then secondarily transferring the toner image from the intermediate transfer member to a sheet, wherein a toner adhesion reduction layer for reducing an adhesion of toner is uniformly formed over the surface.

To achieve the twenty-ninth object, a thirty-third aspect of the present invention provides the intermediate transfer member according to the thirty-second aspect, wherein the toner adhesion reduction layer is composed of zinc stearate.

To achieve the thirtieth object, a thirty-fourth aspect of the present invention provides the intermediate transfer member according to thirty-second, wherein the toner adhesion reduction layer is composed of fluororesin.

To achieve the thirty-first object, a thirty-fifth aspect of the present invention provides an image forming apparatus, comprising the intermediate transfer member as recited in any one of the thirty-second to thirty-fourth aspects.

To achieve the thirty-second object, a thirty-sixth aspect of the present invention provides the image forming apparatus according to the thirty-fifth aspect, wherein the toner adhesion reduction layer is composed of particles adhered on the intermediate transfer member when a block of bound particles is pressed against the intermediate transfer member while rotating the intermediate transfer member.

To achieve the thirty-third, a thirty-seventh aspect of the present invention provides the image forming apparatus according to the thirty-sixth aspect, wherein the block of bound particles is pressed with a controllable force.

To achieve the thirty-fourth aspect, a thirty-eighth aspect of the present invention provides the image forming apparatus according to the thirty-fifth aspect, wherein the following relation is satisfied:

$$L_0/V_L>\rho_V\cdot\epsilon\cdot\epsilon_0$$

where $L_0$ denotes a distance in the rotary transport direction of the intermediate transfer member between a location of a charge given to a surface of the intermediate transfer member and a location of toner moved from the image carrier to the surface of the intermediate transfer member; $V_L$, $\rho_V$ and $\epsilon$ respectively denote a surface moving velocity, volume resistivity and relative permittivity of the intermediate transfer member; and $\epsilon_0$ denotes the vacuum permittivity.

To achieve the thirty-fourth aspect, a thirty-ninth aspect of the present invention provides the image forming apparatus according to the thirty-fifth aspect, wherein the following relation is satisfied:

$$L_1/V_L>\rho_V\cdot\epsilon\cdot\epsilon_0$$

where $L_1$ denotes the shortest distance in the rotary transport direction of the intermediate transfer member among distances between adjacent primary transfer locations, the primary transfer location being defined as a location on the intermediate transfer member to which the toner image on the image carrier to be transferred; $V_L$, $\rho_V$ and $\epsilon$ respectively denote a surface moving velocity, volume resistivity and relative permittivity of the intermediate transfer member; and $\epsilon_0$ denotes the vacuum permittivity.

To achieve the thirty-fourth aspect, a fortieth aspect of the present invention provides the image forming apparatus according to the thirty-fifth aspect, wherein the following relation is satisfied:

$$L_2/V_L>\rho_V\cdot\epsilon\cdot\epsilon_0$$

where $L_2$ denotes a distance of an image carrier located downstream-most among the image carriers in the rotary transport direction of the intermediate transfer member between a primary transfer location and a secondary transfer location, the primary transfer location being defined as a location on the intermediate transfer member to which the toner image on the image carrier to be transferred, the secondary transfer location being defined as a location on the recording medium to which the toner image on the intermediate transfer member to be transferred.

To achieve the thirty-fourth aspect, a forty-first aspect of the present invention provides the image forming apparatus according to the thirty-fifth aspect, wherein the following relation is satisfied:

$$L_3/V_L > \rho_V \cdot \epsilon \cdot \epsilon_0$$

where $L_3$ denotes a distance in the rotary transport direction of the intermediate transfer member between a secondary transfer location and an intermediate transfer member cleaning location, the secondary transfer location being defined as a location on the recording medium to which the toner image on the intermediate transfer member to be transferred, the intermediate transfer member cleaning location being defined as a location at which, after the transfer performed at the secondary transfer location, residual toner on the intermediate transfer member to be removed by an intermediate transfer member cleaning device.

To achieve the thirty-fourth aspect, a forty-second aspect of the present invention provides the image forming apparatus according to thirty-fifth aspect, wherein the following relation is satisfied:

$$L_4/V_L > \rho_V \cdot \epsilon \cdot \epsilon_0$$

where $L_4$ denotes a distance of an image carrier located upstream-most among the image carriers in the rotary transport direction of the intermediate transfer member between a primary transfer location and an intermediate transfer member cleaning location, the primary transfer location being defined as a location on the intermediate transfer member to which the toner image on the image carrier to be transferred, the intermediate transfer member cleaning location being defined as a location at which, after the toner image on the intermediate transfer member transferred to the recording medium, residual toner on the intermediate transfer member to be removed by an intermediate transfer member cleaning device.

Other objects and features of this invention will become apparent from the following description with reference to the accompanying drawings.

BRIEF DESCRIPTION OF THE DRAWINGS

FIG. 25 illustrates a conventional configuration in the one-drum intermediate transfer type that employs an intermediate transfer belt as an intermediate transfer member.

DETAILED DESCRIPTION OF THE PREFERRED EMBODIMENTS

Figure 1:
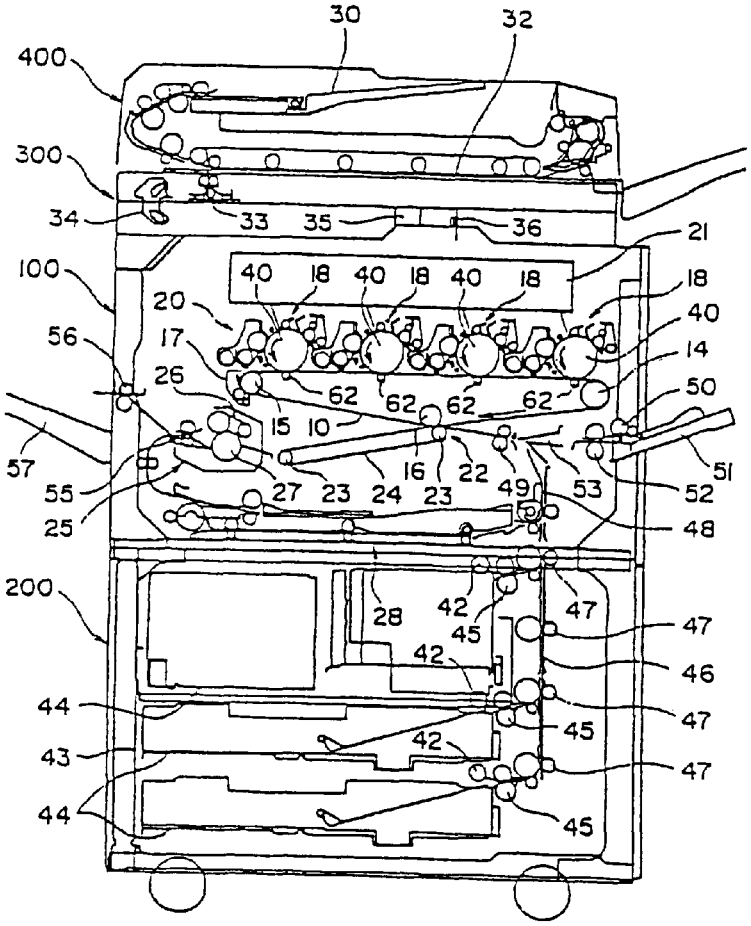
FIG. 1 is a diagram of a totally outlined configuration in a color copier, showing an embodiment of the present invention.

FIG. 1 is a diagram of a totally outlined configuration of a color copier employed to show a first embodiment of the present invention.

Among the reference numerals indicated in the figure, 100 denotes a copier body, 200 denotes a paper feed table for receiving the body, 300 denotes a scanner mounted on the copier body 100, and 400 denotes an automatic draft feeder (ADF) mounted on the scanner.

Figure 2:
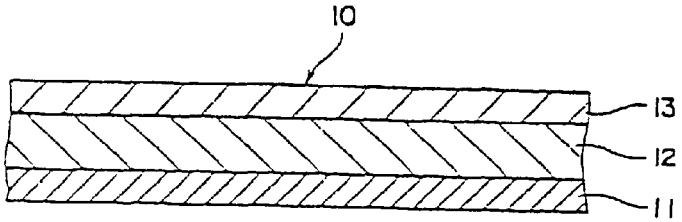
FIG. 2 is a partially enlarged cross-sectional view of a sectional structure of an intermediate transfer member for use in the same color copier.

The copier body 100 comprises an intermediate transfer member 10 of an endless belt type at the center. The intermediate transfer member 10 includes an elastic layer 12 on a base layer 11 as shown in FIG. 2. The base layer 11 is composed of a non-stretchable material such as fluororesin or canvas. The elastic layer 12 is composed of fluoro rubber or acrylonitrile-butadiene copolymer rubber. The elastic layer 12 is covered on a surface with a coating layer 13 to increase smoothness. The coating layer 13 is formed from coating of a resin of fluorine series, for example.

In the example shown in FIG. 1, the intermediate transfer member 10 is put around three support rollers 14, 15 and 16 and, as described later, is possible to rotate clockwise in the figure to transport (rotary transport) an image.

In the example shown in FIG. 1, on the left part from the second roller 15 among the three support rollers, an intermediate transfer member cleaning device 17 is located to remove residual toner resided after an image transfer on the intermediate transfer member 10.

In addition, on the intermediate transfer member 10 put around the first roller 14 and the second roller 15 among three support rollers, along the transport direction, four monocolor image forming unit 18 of black, cyan, magenta and yellow are laterally arrayed. The arrayed four, monocolor image forming unit 18 together configure a tandem image forming apparatus 20.

In the color copier illustrated in FIG. 1, an exposing device 21 is further provided above the tandem image forming apparatus 20.

On the other hand, a secondary transfer device 22 is provided on a location apart from the intermediate transfer member 10 opposite to the tandem image forming apparatus 20. The secondary transfer device 22 shown in FIG. 1 comprises an endless belt or secondary transfer belt 24, which is put around two rollers 23 and is pressed against the third support roller 16 via the intermediate transfer member 10. The secondary transfer device 22 is employed to transfer an image on the intermediate transfer member 10 to a recording medium.

Aside the secondary transfer device 22, a fixing device 25 is arranged to fix the image transferred onto the recording medium. The fixing device 25 comprises an endless belt or fixing belt 26 and a press roller 27 that is pressed against the belt.

The secondary transfer device 22 is also provided with a function of transporting the recording medium with a transferred image to the fixing device 25. When a non-contact charger is arranged as the secondary transfer device 22, however, it is difficult to provide such the recording medium transporting function together.

In the example shown in the figure, below the secondary transfer device 22 and the fixing device 25, a recording medium inverting device 28 is located in parallel with the above-described tandem image forming apparatus 20 for inverting the recording medium to form images on both surfaces thereof.

When the above-described color copier is employed to take a copy, an operator sets a draft on a draft tray 30 in the automatic draft feeder 400. Alternatively, the operator may open the automatic draft feeder 400 to set the draft on a contact glass 32 of the scanner 300, and then close the automatic draft feeder 400 to settle the draft.

When the operator presses a start switch, not shown, the draft set on the automatic draft feeder 400 is transported onto the contact glass 32, then the scanner 300 is driven to move a first travel member 33 and a second travel member 34. If the draft is set on the contact glass 32, then the scanner 300 is immediately driven to move the first travel member 33 and the second travel member 34.

The first travel member 33 emits a light from a light source. The light, once reflected from the draft surface, is reflected again at the first travel member 33 and introduced to the second travel member 34, where it is further reflected at a mirror and introduced through a focusing lens 35 to a reading sensor 36, which reads the draft.

When the operator presses the start switch, not shown, a driving motor, not shown, rotationally drives one of the support rollers 14, 15 and 16, rotationally followed by the other two support rollers, to rotationally transport the intermediate transfer member 10. At the same time, in each monocolor image forming unit 18, an image carrier 40 is rotated to form a monocolor image of each of black, yellow, magenta and cyan on the image carrier 40. Then, along with the transportation of the intermediate transfer member 10, the monocolor images are transferred in turn onto the intermediate transfer member 10 to form a synthesized color image.

When the operator presses the start switch, not shown, in the paper feed table 200 one of paper feed rollers 42 is selectively rotated to feed a recording medium out of one of multi-stage paper feed cassettes 44 equipped in a paper bank 43. A separate roller 45 separates the recording medium to feed it one by one into a paper feed path 46. The recording medium is introduced into a paper feed path 48 in the copier body 100 and stops when it strikes a resist roller 49.

Alternatively, a paper feed roller 50 rotates to feed out a recording medium from a manual feed tray 51 and a separate roller 52 separates the recording medium to feed it one by one into a manual paper feed path 53. The recording medium stops when it strikes the resist roller 49. A usable recording medium includes a sheet of paper or an OHP film, for example.

The resist roller 49 rotates at the same timing with the synthesized color image on the intermediate transfer member 10 to send the recording medium in between the intermediate transfer member 10 and the secondary transfer device 22. The secondary transfer device 22 transfers the synthesized color image to the recording medium to form a color image thereon.

The recording medium with the transferred image is transported over the secondary transfer device 22 into the fixing device 25, which imparts heat and pressure to fix the image. Thereafter, an ejection roller 56 ejects the recording medium, which is then stacked on an ejection tray 57. When a switching claw 55 switches ejection ways, the recording medium enters the recording medium inverting device 28 and, after inverted, it is introduced to the transfer location again. During this process, the recording medium is provided with an image also on the back surface and thereafter it is ejected through the ejection roller 56 onto the ejection tray 57.

After the image is transferred from the intermediate transfer member 10, the intermediate transfer member cleaning device 27 removes residual toner stayed on the intermediate transfer member 10 to prepare the tandem image forming apparatus 20 for the next image formation.

Figure 3:
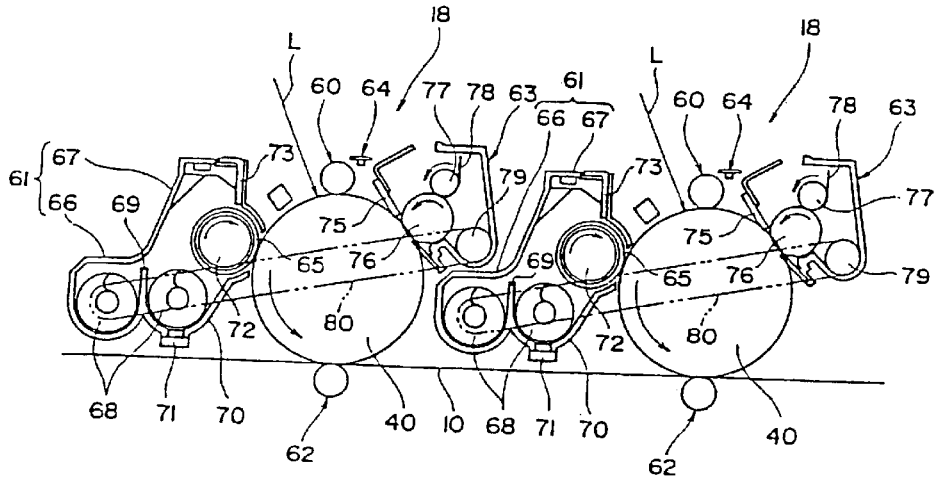
FIG. 3 is a partially enlarged cross-sectional view of a tandem image forming apparatus for use in the same color copier.

FIG. 3 illustrates the individual monocolor image forming unit 18 in the tandem image forming apparatus 20 in detail. The monocolor image forming unit 18 comprises, around the drum-like image carrier 40, a charger 60, a developing device 61, a primary transfer device 62, an image carrier cleaning device 63 and a charge eraser 64, for example. The shown image carrier 40 has a drum-like configuration that includes a simple aluminum cylinder and a photosensitive layer formed thereon. The photosensitive layer is a coating of an organic photosensitive agent. In the present invention, however, the image carrier is not limited to the drum-like configuration, rather it may have an endless belt-like configuration.

A process cartridge, not shown, may be formed to attach and detach all or part of the portions that configure the monocolor image forming unit 18 integrally to and from the copier body 100. This process cartridge may include at least the image carrier 40 to improve the maintenance property.

The charger 60 in the monocolor image forming unit 18 is shaped in a roller in the shown example so that it can contact and apply a voltage on the image carrier 40 to charge it.

The developing device 61, though it may employ a single-component developer, employs a two-component developer consisting of a magnetic carrier and a non-magnetic toner in the shown example. The developing device 61 comprises an agitator unit 66 for agitating and transporting the two-component developer to attach it on a developing sleeve 65. It also comprises a developing unit 67 for transferring the toner in the two-component developer adhered on the developing sleeve 65 to the image carrier 10. The agitator unit 66 is located at a lower position than the developing unit 67.

The agitator unit 66 is provided with two parallel screws 68. A partition 69 is employed to isolate the two screws 68 from each other except for both edges (see FIG. 6). A developing casing 70 has a toner density sensor 71 attached thereon.

On the other hand, the developing unit 67 is provided with the developing sleeve 65 opposing to the image carrier 40 through an opening in the developing casing 70. A magnet 72 is secured in the developing sleeve 65. A doctor blade 73 is located closing the tip to the developing sleeve 65. A gap between the doctor blade 73 and the developing sleeve 65 in the shown configuration is equal to 500 $\mu$m at the closest part.

The two-component developer is transported and circulated while the two screws 68 agitate it, and is fed to the developing sleeve 65. The developer fed to the developing sleeve 65 is lifted and held by the magnet 72 to form a magnetic brush over the developing sleeve 65. This magnetic brush is trimmed to a proper amount by the doctor blade 73. The cut-off developer is returned to the agitator unit 66.

The toner in the developer on the developing sleeve 65 is transferred to the image carrier 40 to visualize an electrostatic latent image on the image carrier 40 when a developing voltage is applied on the developing sleeve 65. After the visualization, the residual developer stayed on the developing sleeve 65 separates from a portion not effected by a magnetic force of the magnet 72 and returns to the agitator unit 66. When the toner density in the agitator unit 66 decreases after the above steps are repeated, the toner density sensor 71 senses the toner density and supplements toner to the agitator unit 66 on the basis of the sensed result.

In the shown configuration, it is determined that the image carrier 40 has a line velocity of 200 mm/s and the developing sleeve 65 a line velocity of 240 mm/s. In addition, the image carrier 40 has a diameter of 50 mm and the developing sleeve 65 a diameter of 18 mm. An amount of toner charge on the developing sleeve 65 ranges from −10 to −30 $\mu$c/g. A developing gap GP between the image carrier 40 and the developing sleeve 65 can be set within a conventional range between 0.8 mm and 0.4 mm. The developing gap GP may also have a smaller value to increase a developing ability.

Further, the image carrier 40 has a thickness of 30 $\mu$m while the optical system has a beam spot with a diameter of 50×60 $\mu$m and a light amount of 0.47 mW. The developing process is performed under such a condition that the image carrier 40 has a charged (pre-exposed) voltage $V_0$ of −700 V and post-exposed voltage $V_L$ of −120 V with a developing bias voltage of −470 V or a developing potential of 350 V.

The roller-shaped primary transfer device 62 is pressed against the image carrier 40 sandwiching the intermediate transfer member 10 therebetween. This primary transfer device 62 is not limited to the roller-shaped configuration and may comprise a non-contact charger.

The image carrier cleaning device 63 comprises a cleaning blade 75 of polyurethane rubber, of which tip is pressed against the image carrier 40. It also comprises a rotatable, conductive fur brash 76 capable of freely rotating in the direction of the arrow while contacting the outer circumference with the image carrier 40. It further comprises a rotatable, metallic electric-field roller 77 capable of freely rotating in the direction of the arrow to apply a bias voltage on the fur brash 76 and a scraper 78 for pressing the tip against the electric-field roller 77. It also comprises a collecting screw 79 for collecting the removed toner.

The fur brash 76 rotates in the counter direction relative to the image carrier 40 to remove the residual toner on the image carrier 40. The toner attached on the fur brash 76 is removed by the electric-field roller 77 that rotates in the counter direction relative to the fur brash 76 and applies a bias voltage. The scraper 78 cleans the electric-field roller 77. The toner collected at the image carrier cleaning device 63 is put aside by the collecting screw 79 and returned to the developing device 61 through a toner recycling device 80 for the recycled use as described in detail later.

The charge eraser 64 may comprise a lamp for emitting a light to the image carrier 40 to initialize a surface potential.

The charger 60 first charges over the surface of the image carrier 40 uniformly as the image carrier 40 rotates. The exposing device 21 then emits a writing light L such as laser and LED light to the image carrier 40 to form an electrostatic latent image on it in response to the contents read out by the scanner 300.

Thereafter, the developing device 61 attaches toner to visualize the electrostatic latent image on the image carrier 40. The primary transfer device 62 transfers the visualized image onto the intermediate transfer member 10. After the image transfer, the image carrier cleaning device 63 removes the residual toner from the surface of the image carrier 40 to clean it and the charge eraser 64 erases charges therefrom to prepare for the next image formation.

Figure 4:
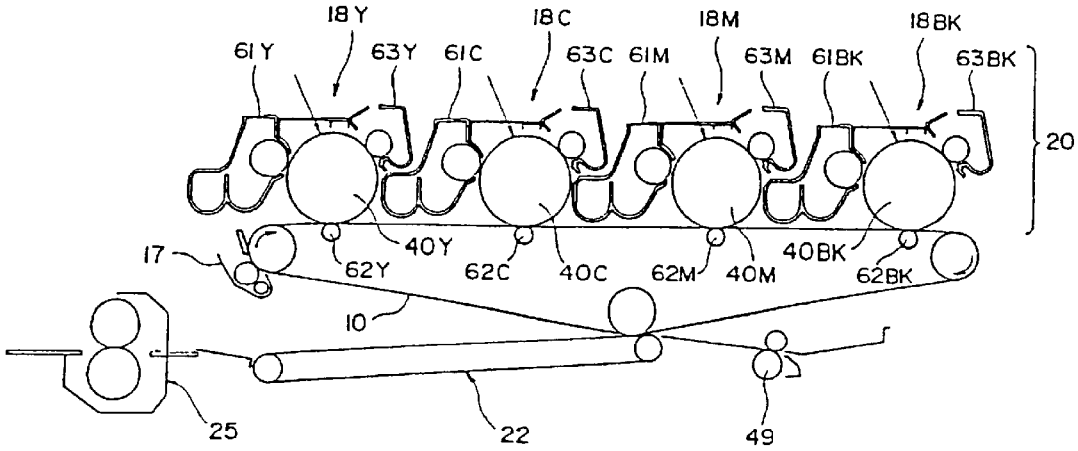
FIG. 4 is an enlarged configuration view of a main part of the same color copier.

FIG. 4 is an enlarged view of the main part of the color copier shown in FIG. 1, showing each monocolor image forming unit 18 in the tandem image forming apparatus 20; each image carrier 40, each developing device 61 and each image carrier cleaning device 63 in the monocolor image forming unit 18; and each primary transfer device 62 arranged opposite to an image carrier 40 in each monocolor image forming unit 18. Each primary transfer device 62 employs each of toner colors for transferring images, which are indicated with BK, Y, M and C suffixed to the reference numeral given to each primary transfer device 62. BK denotes black, Y yellow, M magenta and C cyan.

At this moment, since the image carrier 40 rotates in the direction of the arrow 'a' shown in the figure, a plane of the intermediate transfer member 10 that contacts the image carrier 40 is transported in the direction of the arrow b (FIG. 3). As shown in FIG. 4, in the tandem image forming device 20, the monocolor image forming unit 18 are arranged in an order of yellow, cyan, magenta and black. In addition, they are arranged from upstream to downstream along the direction (rotary transport direction) in which the plane of the intermediate transfer member 10 contacting the image carrier 40 is transported. When the black monocolor image forming unit 18BK is located at a downstream-most location like this way, even if toner on the intermediate transfer member 10 is transferred to the image carrier 40, no remarkable color mixture occurs and the toner can be recycled.

In the first embodiment, among four monocolor image forming unit 18, at least two monocolor image forming unit 18 may be provided with respective toner recycling devices 80. In particular, one monocolor image forming unit 18 located at an upstream-most location in the rotary transport direction of the intermediate transfer member 10 is preferably provided with a toner recycling device 80. In addition, at least the black monocolor image forming unit 18BK is preferably provided with a toner recycling device 80 because it exhibits less toner degradation. In the shown configuration, however, all monocolor image forming unit 18 are provided with respective toner recycling devices 80.

Figure 5:
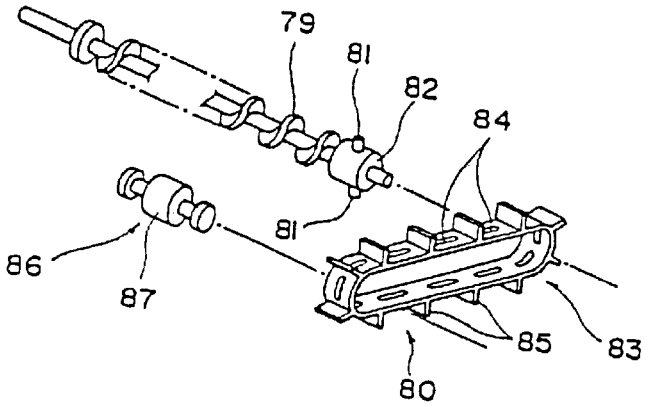
FIG. 5 is an exploded perspective view of a toner recycling device for use in the same color copier.
Figure 6:
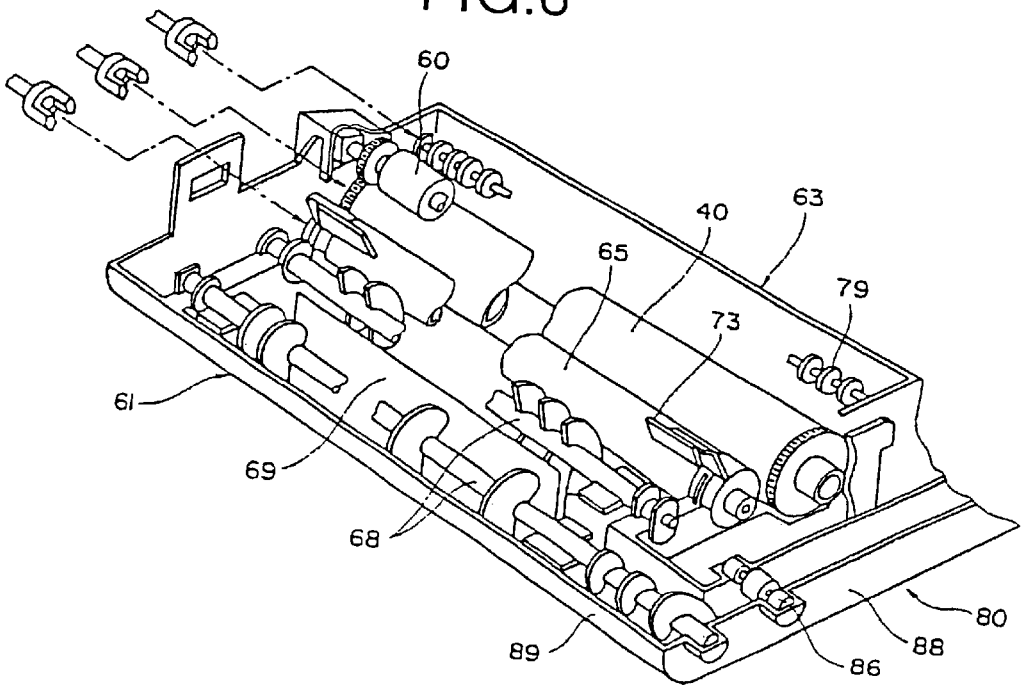
FIG. 6 is a partly sectioned perspective view of the toner recycling device at the side of a developing device.

FIGS. 5 and 6 illustrate the toner recycling device 80. As shown in FIG. 5, the collecting screw 79 in the image carrier cleaning device 63 is provided with a roller unit 82 that has a pin 81 at one end. The toner recycling device 80 includes a collected toner conveying member 83 of the belt type, of which one side is put on the roller unit 82. The collected toner conveying member 83 has an elongated hole 84, into which the pin 81 is inserted. The collected toner conveying member 83 is provided with fans 85 at a certain interval on the outer circumference. The other side of the collected toner conveying member 83 is put on a roller unit 87 of a rotary shaft 86.

The collected toner conveying member 83 is housed together with the rotary shaft 86 in a transport path casing 88 shown in FIG. 6. The transport path casing 88 is formed integrally with a cartridge casing 89 to house one of the two screws 68 of the developing device 61 on one end near the developing device 61.

When the collecting screw 79 is driven with a driving force transmitted from external, it rotates and transports the collected toner conveying member 83. The toner collected at the image carrier cleaning device 63 is conveyed through the transport path casing 83 to the developing device 61 and received inside the developing device 61 as the screws 68 rotates. As described above, the toner is conveyed and circulated together with the developer already present in the developing device 61 by the two screws 68 while agitating them. The toner and developer are fed to the developing sleeve 65 and trimmed by the doctor blade 73, then they are transferred to the image carrier 40 to develop a latent image on the image carrier 40.

According to the depicted configuration, in the image forming apparatus for forming a color image, the monocolor image forming unit 18 is provided with the toner recycling device 80. The monocolor image forming unit 18 includes the developing device 61 and the image carrier cleaning device 63 arranged around the image carrier 40. The toner recycling device 80 conveys the toner collected at the image carrier cleaning device 63 to the developing device 61. Therefore, the toner of each color can be recycled.

A plurality of the monocolor image forming unit 18 is arrayed along the intermediate transfer member 10 to form the tandem image forming apparatus 20. The tandem image forming apparatus 20 forms a synthesized toner image on the intermediate transfer member 10. The synthesized toner image is then transferred to a recording medium to form an image thereon. Namely, the image is formed on the recording medium through the transfer via the intermediate transfer member 10. Therefore, the recording medium can not contact the image carrier 40 directly. As a result, foreign matters such as paper powders and dusts attached to the recording medium can be prevented from mixing into the recycled toner and the image quality can be prevented from degrading.

A transfer rate greatly depends on a resistance. A recording medium generally has a high moisture absorbency and a large resistance variation against environmental variations such as temperature and humidity. On the other hand, the intermediate transfer member 10 is mainly composed of a material such as a resinous material with a resistance larger than that of the recording medium and has less resistance variation against environmental variations. Then, as the configuration described above, when the image is formed on the recording medium through the indirect transfer via the intermediate transfer member 10, the transfer rate can be stabilized. At the same time, the resistance variation is reduced against the environmental variations compared to the direct transfer type for directly transferring to the recording medium.

In the configuration described above, the present invention is applied to a color copier that forms a synthesized color image on a recording medium using individual monocolor image forming unit 18 to form respective monocolor images, which are synthesized to the color image.

The present invention, however, is not limited to the color image forming apparatus. Rather, it is also applicable to a two-color image forming apparatus that comprises two monocolor image forming unit 18 arranged in line for forming respective monocolor images, which are transferred via an intermediate transfer member to a recording medium to form a two-color image thereon. In this case, individual monocolor image forming unit 18 are provided with respective toner recycling devices 63 for conveying the toner collected at the image carrier cleaning device 63 to the developing devices 61 to achieve the same effect.

Toner comprises a resin such as polyester, polyol and styrene acrylate mixed with a charge control agent (CCA) and a colorant, as well as a substance such as silica and titanium oxide added onto the outer surface of the resin to improve the charging property and fluidity. The additive has a particle diameter within a range between 0.1 to 1.5 [$\mu$m]. The colorant includes carbon black, phthalocyanine blue, quinacridon and carmine. The charged polarity in the depicted example is negative.

Usable toner may comprise a matrix toner mixed with a dispersed wax and the like and an additive of the above type added on the outer surface of the matrix toner. The toner used in the description until now is one that is produced by a pulverizing method but may also be produced by a polymerizing method and the like. In general, the toner produced by the polymerizing method and a heating method can be formed to have a shape factor of 90% or more and an extremely high cover rate of the additive due to the shape.

The shape factor is originally a sphericity that is defined as "(a surface area of a sphere having a volume equal to a particle)/(a surface area of a real particle)×100%". The sphericity is considerably difficult to measure, so a roundness is employed to compute the shape factor instead. The roundness is defined as (a circumferential length of a circle having a projected area equal to a particle)/(a projected contour length of a real particle)×100%". According to this definition, the more the projected circle closes to a true circle, the more the roundness closes to 100%.

The toner has a volume-averaged particle diameter, which is preferably within a range between 3 to 12 $\mu$m, and is determined 6 $\mu$m in the first embodiment. Such the toner is sufficiently applicable to a high-resolution image of 1200 dpi or more.

A magnetic particle has a metallic or resinous core that contains a magnetic material such as Ferrite, and a surface layer that is covered with a silicon resin and the like. Preferably, it has a particle diameter within a range between 20 to 50 $\mu$m. As for its resistance, it has a dynamic resistance optimally within a range between $10^4$ to $10^6\Omega$. A measured value of the dynamic resistance is obtained from a measurement, which comprises: attaching the magnetic particle on a roller ($\phi$ 20; 600 RPM) that contains a magnet inside; contacting an electrode having an area of 65 mm wide and 1 mm long with the roller via a gap of 0.9 mm; and applying a voltage of the upper limit level of breakdown (from 400 V for a high resistance silicon coated carrier to several V for an iron powder carrier) across the roller and the electrode.

The developing sleeve 65 has a non-magnetic, rotatable sleeve-like shape and contains a plurality of magnets 72 arranged inside. The magnets 72 are secured so that they effect magnetic forces to the developer when it passes a certain location. In the illustrated example, the developing sleeve 65 has a diameter of ϕ18 and a surface that is roughened to have a roughness within a range of 10 to 30 um RZ. Methods of roughening the surface include a sand blast technology and a process of forming a plurality of grooves with a depth of 1 to several mm.

The magnets 72 have five magnetic poles, $N_1$, $S_1$, $N_2$, $S_2$ and $S_3$, located along the rotational direction of the developing device 65 on the basis of the location of the doctor blade 73. The mixture of the toner and magnetic particles produced at the magnets 72 is carried as a developer on the developing sleeve 65. At this moment, the toner obtains a defined charge after mixed with the magnetic particles. Preferably, the charge in the shown example is contained within a range between −10 to −30 [$\mu$C/g]. The developing sleeve 65 is located, opposing to the image carrier 40, in a region at $S_1$ side of the magnets 72 that form a magnetic brush for developer.

Figure 7:
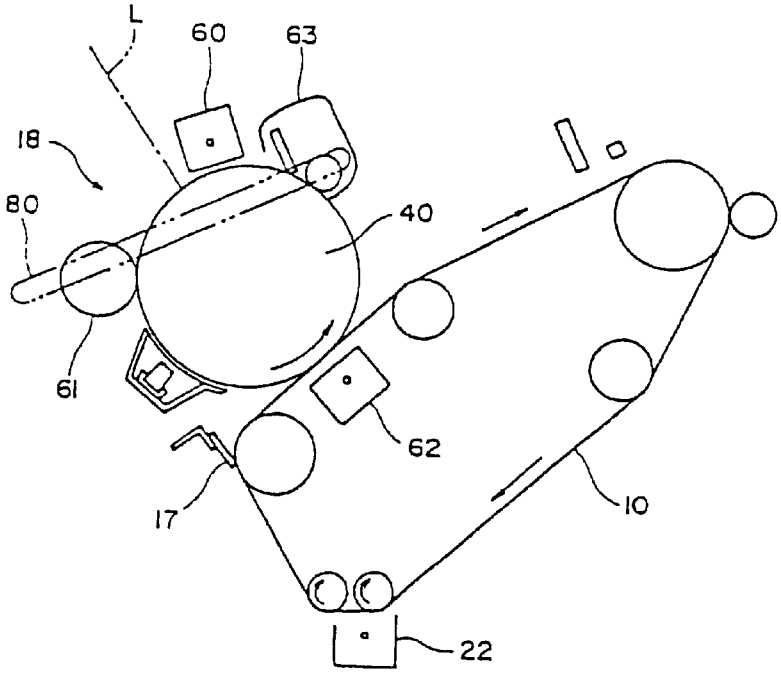
FIG. 7 shows a main configuration of a monocolor image forming apparatus.

In the image forming apparatus for forming a multicolor image as described above, the description is performed on such the example that comprises the tandem image forming device 20 as well as the toner recycling device 80. If the present invention is applied to a monocolor image forming apparatus, it can be configured as shown in FIG. 7. The same parts in FIG. 7 as those in the configuration described above are indicated with the same reference numerals and omitted to repeatedly describe them.

In the monocolor image forming apparatus shown in FIG. 7, monocolor image forming device 18 includes a developing device 61 and an image carrier cleaning device 63 around an image carrier 40. The monocolor image forming device 18 is employed to form a toner image on the image carrier 40. The toner image is transferred once to an intermediate transfer member 10. Thereafter, the toner image on the intermediate transfer member 10 is transferred to a recording medium to form a monochromic image thereon.

The monocolor image forming device 18 includes a toner recycling device 80 for conveying toner collected at the image carrier cleaning device 63 to the developing device 61. The toner recycling device 80 is configured in the same manner as the previous example shown in FIGS. 5 and 6, for example.

Figure 8:
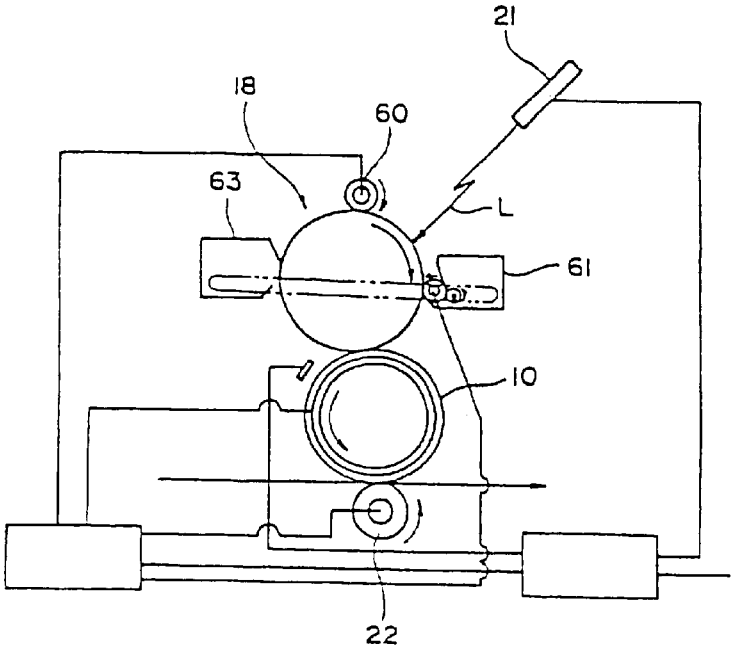
FIG. 8 shows a main configuration of another monocolor image forming apparatus.

In the example shown in FIG. 7, the image carrier 40 comprises a drum and the intermediate transfer member 10 comprises a belt. The present invention is not limited to such the configuration. For example, the intermediate transfer member 10 may also comprise a drum as shown in FIG. 8. The same parts in FIG. 8 as those in the configuration described above are indicated with the same reference numerals and omitted to repeatedly describe them. The image carrier 40 is not limited to the drum and may comprise a belt as well.

Also in the examples shown in FIGS. 7 and 8, the image forming apparatus may be provided with a process cartridge that can be integrally attached to and detached from a body of the apparatus. The process cartridge may include at least the image carrier 40.

A developing bias voltage is applied to the developing device 61 at the time of development. This is described next in detail.

Figure 9:
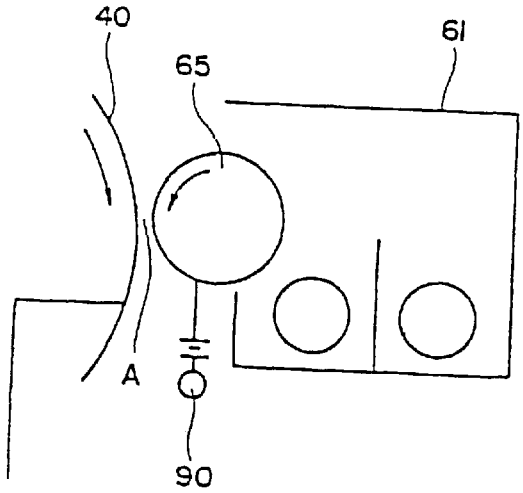
FIG. 9 illustrates a developing device for use in the present invention.

As illustrated in FIG. 9, the developing device 61 has a developing sleeve 65. A vibrating bias voltage consisting of a DC voltage and an AC voltage superimposed thereon is applied as the developing bias voltage from a power source 90 to the developing device 61 at the time of development. In the vibrating bias voltage, a background potential and an image potential are located between the maximum and the minimum of the vibrating bias voltage. Through the application of such the voltage, an alternate electric field is generated across a developing portion A. The toner and magnetic particles in the developer vibrate intensively in this alternate electric field. Thanks to this vibration, becoming free from an electrostatic force to tie the toner to the developing sleeve 65 and magnetic particles, the toner can fly to the image carrier 40 and adhere to a latent image thereon.

Preferably, the vibrating bias voltage has a difference between the maximum and the minimum, (peak-to-peak voltage), of 0.5 to 5 kV and a frequency of 1 to 10 kHz. The vibrating bias voltage may have a waveform of a rectangular wave, sine wave or triangular wave. The DC component of the vibrating bias voltage is located in between the background potential and the image potential as described above. Though it is preferable that the DC component is closer to the background potential than the image potential to prevent the fogged toner from adhering on a region at the background potential.

If the vibrating bias voltage has a waveform of the rectangular wave, its duty ratio is desirably 50% or less. The duty ratio is herein defined as a ratio of a time period of the toner that moves toward the image carrier 40 in one cycle of the vibrating bias voltage. Thus, as for the bias to allow the toner to move toward the image carrier 40, a difference between a peak value and a time average can be increased. As a result, the motion of the toner can be activated further. In addition, the toner can adhere on the latent image surface depending on the electric field distribution with fidelity to improve the roughness and resolution.

As for the bias to allow the magnetic particle with a polarity opposite to the toner to move toward the image carrier 40, a difference between a peak value and a time average can be decreased. As a result, the motion of the carrier can be suppressed. In addition, a probability of the magnetic particle attached to the background of the latent image can be greatly decreased. Even if uncharged or insufficiently charged impurities are present, they are not developed and attached on the image carrier 40. Thus, it is possible to prevent the image from degrading and maintain the image quality.

The toner for use in the developer will be described below.

The toner contains a release agent. The release agent includes a polyolefin wax (polyethylene wax, polypropylene wax and the like); a long chain hydrocarbon (paraffin wax, Sasol wax and the like); and a carbonyl-group-containing wax. Among those release agents, the most preferable one is the carbonyl-group-containing wax. The carbonyl-group-containing wax includes a polyalkanoic acid ester (carnauba wax, Montan wax, trimethylol propane tribehenate, pentaerythritol tetrabehenate, pentaerythritol diacetate dibehenate, glycerin tribehenate, 1,18-octadecane diol distearate and the like); a polyalkanol ester (trimellic acid tristearyl, distearyl maleate and the like); a polyalkanoic acid amide (ethylene diamine dibehenyl amide and the like); a polyalkyl amide (trimellitic acid tristearyl amide and the like); and a dialkyl ketone (distearyl ketone and the like).

Among those carbonyl-group-containing waxes described above, the polyalkanoic acid ester is preferable. According to the present invention, the waxes have melting points of 40 to 160° C. in general, preferably 50 to 120° C., and more preferably 60 to 90° C. The wax with a melting point below 40° C. badly affects on the heat resistive preservation. The wax with a melting point above 160° C. tends to cause a cold offset at the time of fusing at a low temperature. Preferably, the wax has a melt viscosity of 5 to 1000 cps, more preferably 10 to 100 cps, as a measured value at a temperature 20° C. higher than a melting point. If the melt viscosity exceeds 1000 cps, the wax has a poor effect in improving the anti-hot offset and low temperature fusing properties. The content of the wax in the toner is normally 0 to 40% by weight, preferably 3 to 30% by weight.

If the toner contains a release agent, the toner can be released without applying a release agent such as silicon oil at the fixing device 25. Accordingly, an oilless fusing can be achieved. If a wax is present outside the toner resin, the wax plays a role of a lubricant. From this effect, the toner resin itself is not damaged and pulverized when it touches a cleaning member. A test was performed for determining a time variation in an image quality depending on the presence/absence of the wax. The toner with no wax added exhibits, after 190 k-sheets, degradation, increased cohesion degree and lowered developing performance of the toner and degradation of the image quality. To the contrary, the toner that contains 3% by weight of the Karunauba wax can maintain, until 250 k-sheets, the image quality without degradation of the toner that is repeatedly recycled.

Next, shapes of the toner will be described below.

The pulverization method and the polymerization method produce usable toner. The pulverization method and the polymerization method are possible to produce toner with a smooth surface, which has a shape factor or roundness of 90% or more. In general, spherical toner is represented by an index of sphericity that is equal to 1 for a true sphere. As the toner becomes a surface-pulverized toner, the sphericity lowers accordingly.

A roundness of a sphericity-projected image, SR, can be defined as SR=(a circumferential length of a circle with the same area as a particle projected area/a circumferential length of a particle projected image)×100%. The more the toner closes to a true sphere, the more the roundness has a value close to 100%.

The spherical toner in the first embodiment has an effect that can be described in comparison with the conventional pulverized toner (in an indeterminate form). The conventional toner A has components of 0.2 wt. % silica and 0.3 wt. % titanium oxide. On the other hand, the toner B (First embodiment) has components of 0.5 wt. % silica and 0.7 wt. % titanium oxide. One of main functions of an additive is to reduce cohesive forces among toner particles to prevent the toner from creating a cohesive mass and obtain a uniform development and transfer property in "a disentangled state" as long as possible.

The near-spherical toner B has a smaller surface area than that of the conventional toner A in consideration of a ratio of the toner that attaches around the matrix toner as a cover rate. The cover rate by the additive in the toner B can be higher than that of the toner A due to the smaller surface area. Therefore, the toner B intends to have an improved fluidity and can easily move over the developing sleeve 65, resulting in an improved developing ability of the image forming apparatus. The use of a toner with a roundness of 90 or more can improve, due to a smooth toner surface, a transfer rate up to 92% while the conventional pulverized toner has a transfer rate of 88%. Accordingly, the use of the toner B can reduce an amount of recycled toner and prevent an image from degrading because the image is hardly affected from the toner pulverized at the time of recycling.

Next, a distribution curve of (toner charge)/(toner particle diameter) will be described below.

A distribution of particle diameters and charges of toner on the developing device 65 was measured. The measured result is described below. An E-SPART ANALYZER, available from Hosokawa-Micron Inc., was employed in the measurement. The E-SPART ANALYZER is operable, though its detailed description is omitted, to blow an air to the toner on the developing device 65 to catch the motion thereof in an electric field, thereby obtaining data regarding particle diameters and charges of individual toner. In this confirmative experiment, 3000 pieces of toner were sampled to observe differences in distributions. In addition, this measurement mainly employs a distribution of q/d, which is obtained by dividing the charge on the toner by the particle diameter of the toner. The use of the distribution of q/d is due to the fact that the charge depends on the particle diameter of the toner.

Figure 10:
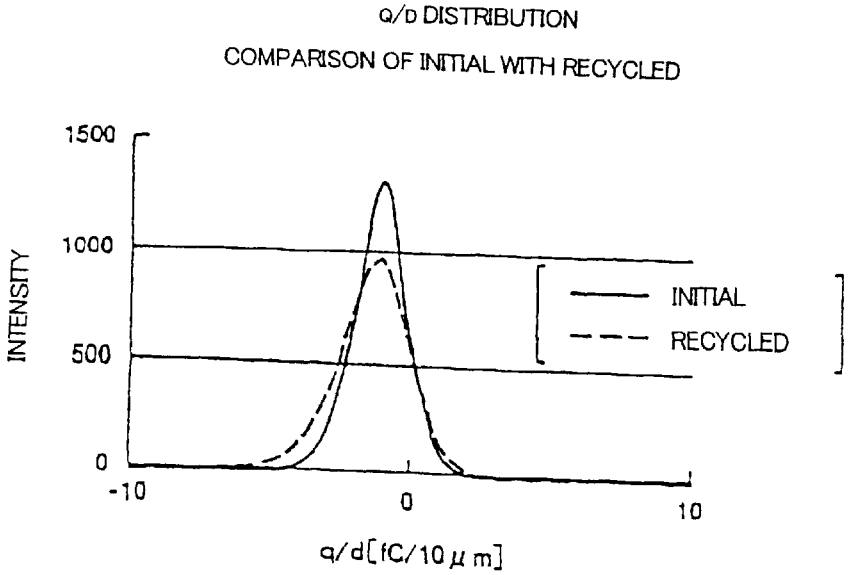
FIG. 10 shows a distribution curve of (toner charge)/(toner particle diameter)

Most preferably, the toner for use in the measurement includes a dry toner that contains at least denatured polyester as a toner binder, and a polymerized toner that is produced by the polymerization method. The former toner is employed in the first embodiment. This measured result is described. The toner has a shape factor, SF=95%. Initially, the distribution of the particle diameters and charges of the toner on the developing sleeve was measured. The charge distribution was sharp as shown in FIG. 10. The charge distribution has a half-value width of 1.1 [fC/10 $\mu$m].

As an index of sharpness, the half-value width is employed generally. It should be noted that that the smaller the half-value width the sharper the distribution. If the distribution is sharp, a uniform development can be achieved in general because there are many toner that have relatively closer values of q/d and there are many toner that have the same developing ability. To the contrary, if the distribution is broad, the present toner charges extend in a wide range and the developing abilities also extend widely. Accordingly, a variation easily occurs in an amount of development. In addition, when toner located at lower charged parts in the distribution increase, a ground contamination occurs easily.

Next, a half-value width after recycling was measured in the same manner as the above measurement. As a result, the charge distribution after recycling was found to have a half-value width of 1.7 [fC/10 $\mu$m]. A charge distribution after recycling was also measured in a system that employs a conventional pulverized toner and it was found to have a half-value width of 2.7 [fC/10 $\mu$m]. An increased half-value width after recycling is due to the fact that the toner is pulverized with a press force applied at the time of cleaning when the toner is sandwiched between the cleaning member or blade and the image carrier 40. Namely, when the toner is pulverized, a present ratio of toner with smaller particle diameters than an average particle diameter increases. In addition, the toner with smaller particle diameters attach to other toner to form secondary particles or toner with larger particle diameters and consequently broaden the q/d distribution.

Figure 11:
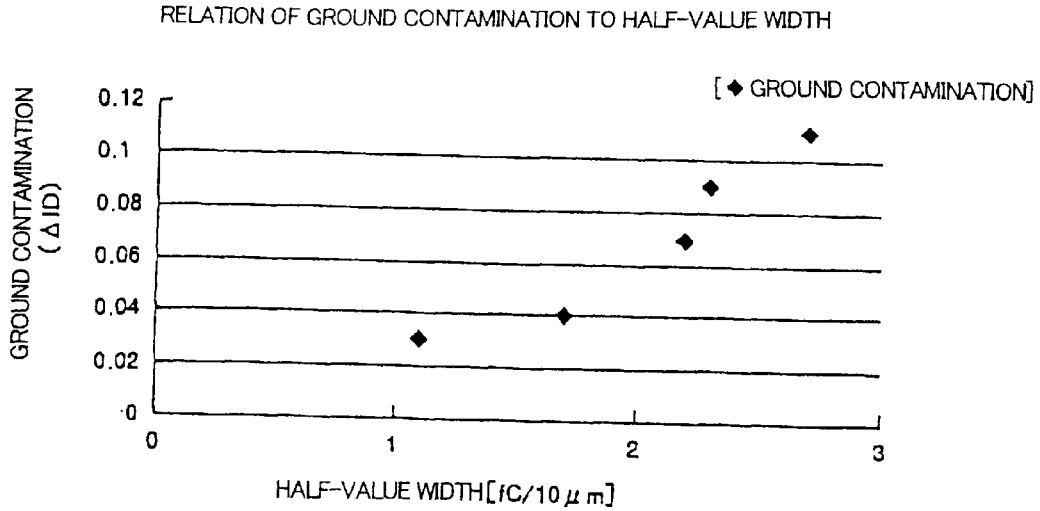
FIG. 11 shows a relation between a half-value width of the distribution curve and a ground contamination.

FIG. 11 shows a relation between the half-value width described above and a ground contamination. If the half-value width exceeds 2.2, it is found that the ground contamination exceeds a limit value of 0.08 (ΔID employs a difference in reflection densities for an undeveloped recording paper). In the conventional pulverized toner, the ground contamination property after recycling drops down below the limit value. To the contrary, the use of the toner with the half-value width of 2.2 or less in the first embodiment is found that it can maintain a sufficient charge and an image quality without degradation after recycling.

Next, elasticizing of the intermediate transfer member 10 will be described below.

Preferably, the intermediate transfer member 10 is determined to have a hardness HD within a range of $10° \leqq HS \leqq 60°$ (JIS-A). A belt has a sufficiently low hardness but has a possibility of slip occurring at a driving transmission. To the contrary, the use of a hard roller can extremely reduce variations in rotations or running. On the other hand, the use of an excessive harder roller reduces a margin due to accuracy and causes a possibility of insufficient adhesion of the roller to the image carrier 40. To avoid such the malfunction, in the first embodiment the intermediate transfer member 10 is provided with an elastic layer 12 to reduce hardness and give flexibility in order to improve a margin of adhesion to the image carrier 40 and a transfer rate. In addition, it reduces an amount of recycled toner to prevent an image from degrading and maintain an image quality.

As for a substrate with hardness below 10° JIS-A, it is very difficult to mold it with nice dimensional accuracy. This is due to the fact that such the substrate can be easily affected from constriction and expansion at the time of molding. In a general method, an oily component is contained in the substrate to soften it. A continuous running under pressure has a problem because it makes the oily component seep out. It has been known that the seep of the oily component contaminates toner carried on the surface of the intermediate transfer member 10 and extremely lowers a transfer rate.

On the other hand, as for a substrate with hardness above 60° JIS-A, it is possible to mold it with better accuracy due to an increase in hardness and achieve suppressed, less oil contents, thereby reducing contamination of the toner. A usable range in consideration of a contact pressure is narrowed, however, it is accordingly required to set an amount of engagement or the contact pressure precisely. With respect to a comparison of an intermediate transfer roller A (hardness 61° JIS-A) to an intermediate transfer roller B according to an example of the present invention (hardness 40° JIS-A), a result will be described below.

Figure 12:
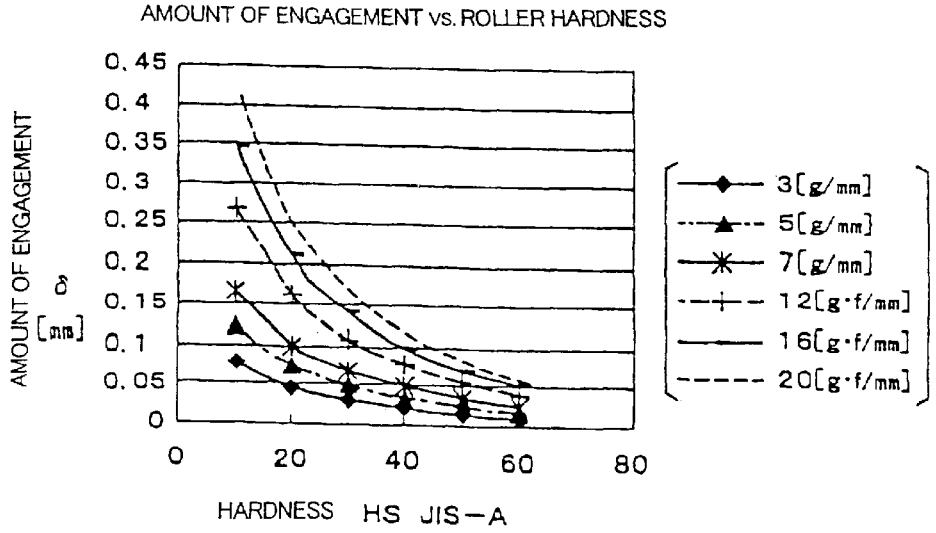
FIG. 12 shows a relation between hardness of an intermediate transfer member and an amount of engagement into an image carrier.

FIG. 12 shows a relation between hardness of the intermediate transfer member 10 and an amount of engagement to the image carrier 40 using a contact pressure as a parameter. When a variation width of the contact pressure is determined 3 to 8 gf/mm for the intermediate transfer roller A and 3 to 12 gf/mm for the intermediate transfer roller B, a width of the amount of engagement comes respectively to 0.02 mm and 0.05 mm. Accordingly, the intermediate transfer roller A is required to have a dimensional accuracy about 2.5 times larger compared to the intermediate transfer roller B.

As described above, the type of the intermediate transfer roller B has a margin wider than that of the intermediate transfer roller A. It can be considered that the wider margin can reduce a variation of an air gap between the image carrier 40 and the intermediate transfer member 10 and stabilize the transfer rate. In contrast, if the hardness is relatively higher, a variation of the amount of engagement increases and the transfer rate decreases. A transfer rate measurement is performed for the intermediate transfer roller B of the present invention (hardness 40° JIS-A) in comparison with the conventional intermediate transfer roller A with relatively higher hardness (hardness 61° JIS-A). As a result, a transfer rate of 94% is obtained for the intermediate transfer roller B while 90% for the conventional intermediate transfer roller A. Accordingly, in the first embodiment, the amount of the recycled toner can be reduced and the image quality is hardly affected from the toner pulverization and so forth at the time of recycling. Therefore, the recycling can not degrade the image.

Figure 13:
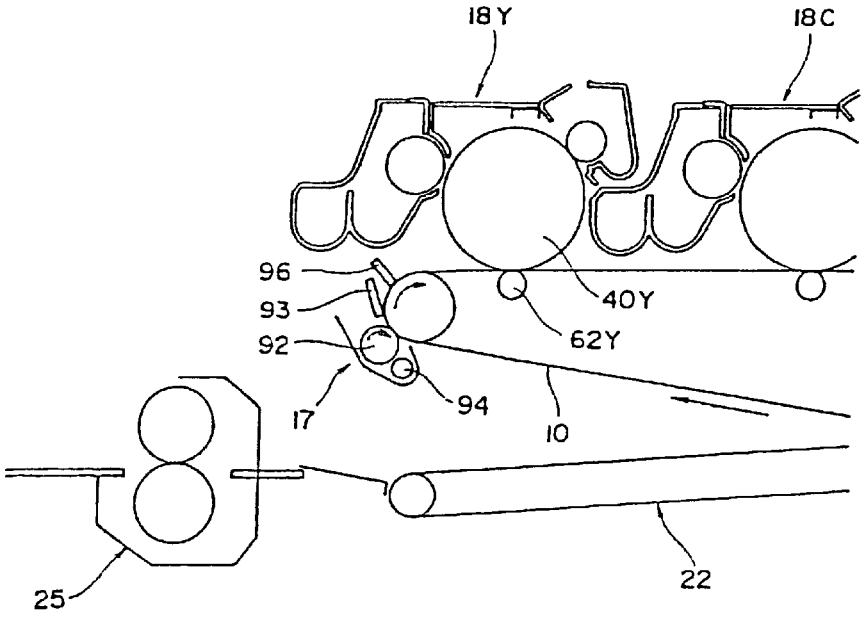
FIG. 13 is an enlarged diagram of a configuration example around another intermediate transfer member cleaning device.

In an example shown in FIG. 13, the intermediate transfer member cleaning device 17 is provided with a fur brash 92 and a cleaning blade 93 as cleaning members. The fur brash 92 contacts the intermediate transfer member 10 and rotates in the counter direction relative to the intermediate transfer member. The cleaning blade 93 on the other hand is located at a location downstream from the fur brash 92 to support the base end and press the tip end against the intermediate transfer member 10. The reference numeral 94 shown in FIG. 13 denotes a coil- or screw-shaped, toner conveying member.

Residual toner resided after the secondary transfer on the intermediate transfer member 10 is removed with the fur brash 92 and the cleaning blade 93 as the intermediate transfer member 10 rotates. The removed toner is conveyed on the toner conveying member 94 to a waste toner bottle, not shown.

A block of bound particles 96 is located downstream from the intermediate transfer member cleaning device 17. The block 96 is formed in a stick of compacted particles that contain zinc stearate or fluororesin. The block of bound particles 96 is secured by a spring-actuated holder, not depicted, which supports the base end and presses the tip end against the intermediate transfer member 10.

Figure 14:
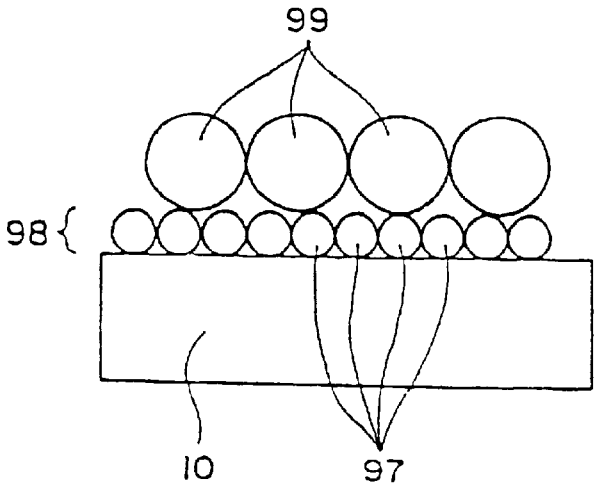
FIG. 14 is a partially enlarged diagram showing a condition of toner adhesion to the intermediate transfer member.

As the intermediate transfer member 10 rotates, the block of bound particles 96 attaches particles from the block to form a toner adhesion reduction layer 98 consisting of particles 97 adhered on the surface of the intermediate transfer member 10 as shown in FIG. 14. Preferably, the toner adhesion reduction layer 98 is uniform, more preferably in a state of a single layer or in a state of the most densely filled state. The reference numeral 99 shown in FIG. 14 denotes toner attached on the intermediate transfer member 10.

The particles contained in the toner adhesion reduction layer 98 have diameters desirably ranging between 0.1 to 1.0 μm. A larger particle diameter causes roughness, even if the toner adhesion reduction layer 98 is formed uniformly, to possibly trap the toner.

Figure 15:
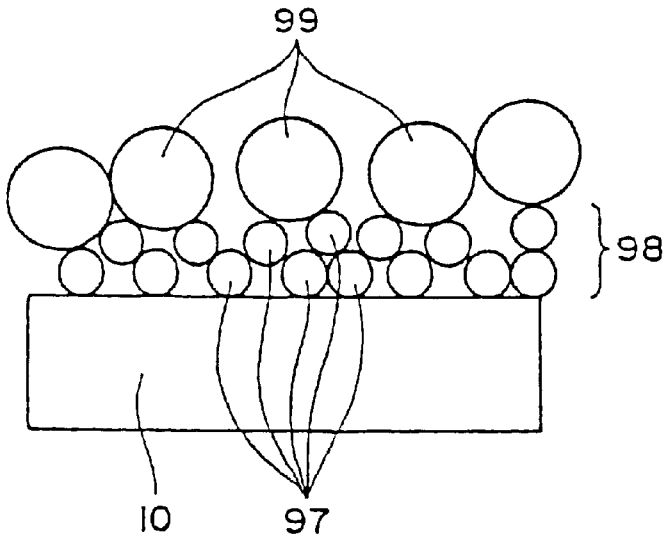
FIG. 15 is a partially enlarged diagram showing another condition of toner adhesion to the intermediate transfer member.

The block of bound particles 96 can be pressed optimally with a force within a range of 1 to 20 g/cm. If the force exceeds 20 g/cm, the particles 97 attach excessively as shown in FIG. 15 and may form two or three toner adhesion reduction layers 98. In such the case, possibly the toner once transferred on the intermediate transfer member 10 is not held on the surface thereof. Otherwise, it is displaced during transportation of the toner attached on the intermediate transfer member 10. If the force is lower than 1 g/cm, the block of bound particles 96 can not contact uniformly with the intermediate transfer member 10, resulting in a portion that has no toner adhesion reduction layers 98 formed therein. Consequently, the toner is facilitated to adhere on the surface of the intermediate transfer member 10.

In the illustrated example, the block of bound particles 96 is directly pressed against the intermediate transfer member 10 to attach the particles 97 onto the intermediate transfer member 10 from the block of bound particles 96. Alternatively, a brush, not shown, may be employed to cut away particles from the block of bound particles 96 and attach them on the intermediate transfer member 10.

In this case, amounts of engagement of the brush into the block of bound particles 96 and into the intermediate transfer member 10 are optimally 0.5 mm to 2 mm, respectively. If the amount is larger than 2 mm, a remarkable variation occurs in the brush contact. If the amount is smaller than 0.5 mm, it would be difficult due to a reduced contact pressure to scrape the particles away from the block of bound particles 96 and attach the particles on the surface of the intermediate transfer member 10 sufficiently.

The particles 97 using zinc stearate is herein described. The zinc stearate has a nice dispersion in toner but has a charging property opposite to that of the toner and therefor a high adhesion to the toner. Materials similar to this include wax materials, which employ organic materials such as a carnauba wax and polypropylene.

In the configuration described above, the use of zinc stearate increases the adhesion to the toner 99 and ensures the retention of the toner 99 on the intermediate transfer member 10. On the other hand, the particles 97 are most densely filled over the intermediate transfer member 10, extremely reducing a possibility of the toner 99 attaching directly to the intermediate transfer member 10. Further, as the zinc stearate has a charging property opposite to that of the toner, the toner 99 is facilitated to adhere the zinc stearate. At the same time, the zinc stearate reduces an adhesion between the zinc stearate and the intermediate transfer member 10. Therefore, the residual toner on the intermediate transfer member 10 can be scraped away sufficiently by the cleaning device 17.

The fluororesin-containing particles 97 is described next.

The fluororesin has a release property against surface materials of the toner 99, intermediate transfer member 10 and image carrier 40. This is because fluorine itself has a surface energy lower than those of other materials. The fluororesin also has a high release property against the intermediate transfer member 10 and accordingly it can prevent the toner and other members from attaching on the surface.

Main materials of the fluororesin include polytetrafluoroethylene (PTFE), tetrafluoroethylene-perfluoroalkylvinyl ether (PFA), tetrafluoroethylene-hexafluoropropylene polymer (FEP), polychlorotrifluoroethylene (PCTFE), tetrafluoroethylene-ethylene copolymer (FTFE), chlorotrifluoroethylene-ethylene copolymer (FCTFE), polyvinylidene fluoride (PVDF) and polyvinyl fluoride (PVF). A combination of these materials and inclusion of a conductive material should be controlled appropriately because they greatly effect on a volume and surface resistance property of the intermediate transfer member 10.

When the particle 97 employs the fluororesin material, it is charged essentially with a polarity opposite to that of the toner 99. Therefore, the particle 97 reduces an electrostatic attachment to the toner 99 and allows the cleaning device 17 to scrape away the residual toner stayed after transfer on the intermediate transfer member 10 in order to prevent an after-image from occurring in the next image.

A force necessary for pressing the above-mentioned block of bound particles 96 may be controllable.

Figure 16:
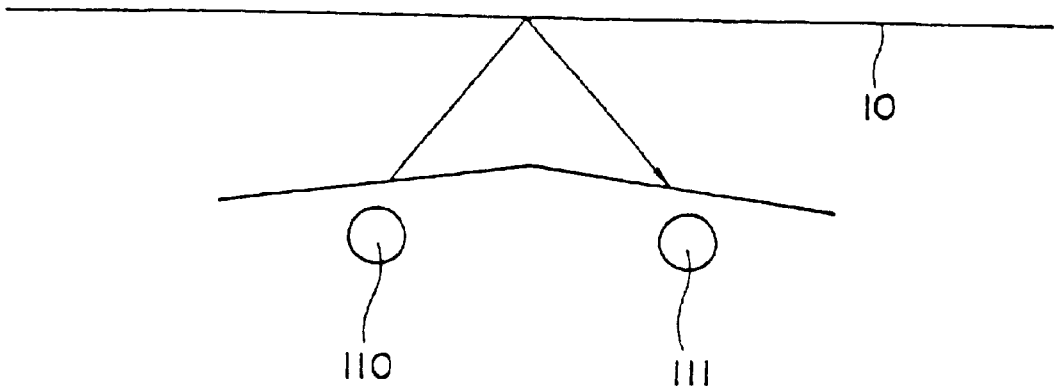
FIG. 16 illustrates a configuration of an optical detecting unit for measuring a density of a developed toner image pattern formed on the intermediate transfer member.

A configuration can be considered to control the pressing force. As shown in FIG. 16, it may comprise a light emitting device 110 and a photoreceptive device 111, for example, which are directed to the intermediate transfer member 10. A light emitted from the light emitting device 110 such as a photosensor enters the surface of the intermediate transfer member 10, which has a developed toner image formed thereon, and is reflected therefrom then enters the photoreceptive device 111. In this process, a density is detected and the pressing force of the block of bound particles 96 is controlled against the intermediate transfer member 10 based on the density.

Figure 17:
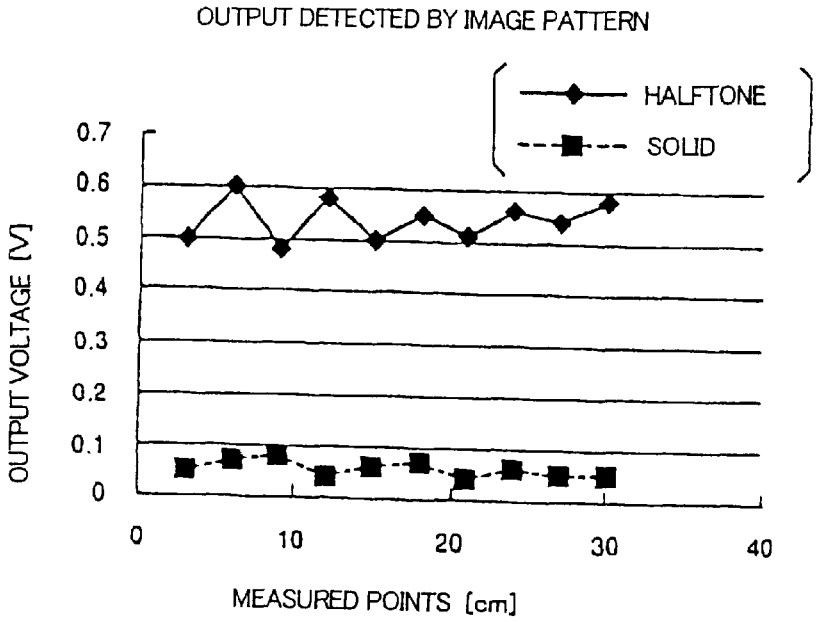
FIG. 17 shows output voltages detected by image patterns.

5 to 10 detection timings are determined at a minimum interval of about 3 cm for a 29.7 mm long A4-size sheet. Output voltages detected by image patterns under such the condition are shown in FIG. 17. It is found in FIG. 17 that a halftone image has a higher output and a solid image a lower output.

The halftone image has a lower area ratio of the residual toner compared to the solid image. There fore, the toner adhesion reduction layer 98 is easily scraped away and partly peeled off possibly when the cleaning blade 93 contacts it.

Figure 18:
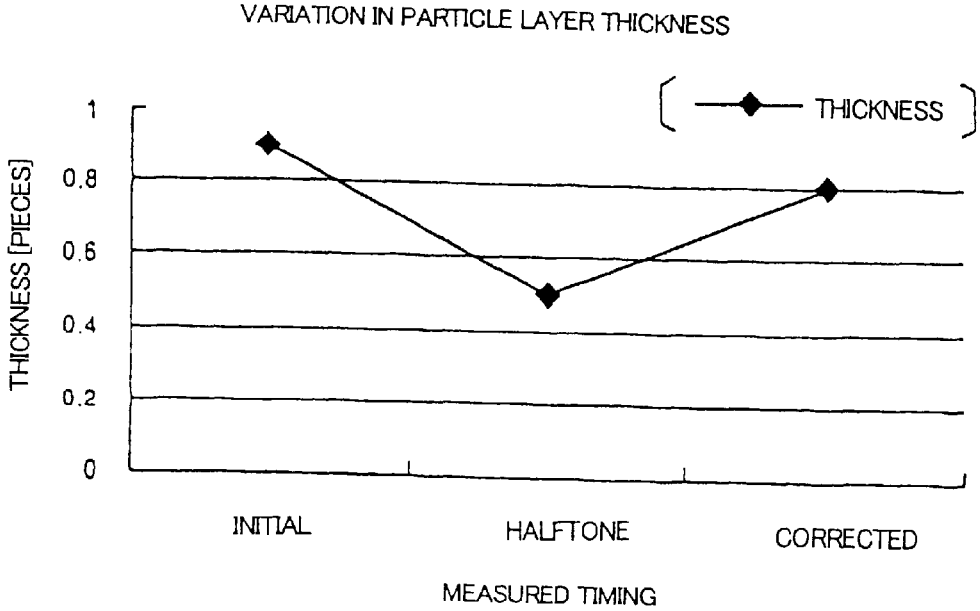
FIG. 18 shows a variation in a thickness of a layer for reducing toner adhesion.

Then, when an integrated value accumulated from the beginning reaches a certain value previously set, the press force against the block of bound particles 96 is increased from 10 g/cm up to 15 g/cm. This is an amount corresponding to about 10-sheet image formation to facilitate the formation of the toner adhesion reduction layer 98 as shown in FIG. 18. A press force and time, greatly depending on the process line velocity as described before, should be optimized in the system.

Desirably, the intermediate transfer member 10 is rotated to contact the cleaning blade 93 of the cleaning device 17 with the intermediate transfer member 10 when no image is formed in order to remove particles attached on the surface. Thereafter, the block of bound particles 96 is pressed for a certain time period to form a uniform, toner adhesion reduction layer 98.

If the intermediate transfer member 10 is rotated to contact the cleaning blade 93 of the cleaning device 17 with the intermediate transfer member 10 when no image is formed, the toner adhesion reduction layer 98 can be peeled off in about one minute. This is because the toner adhesion reduction layer 98 is simply attached and therefore a longer contact scratches and generates roughness on the surface of the intermediate transfer member 10 together with an interaction with the cleaning blade 93.

The block of bound particles 96 is then pressed for about two minutes to form a uniform, toner adhesion reduction layer 98. Like this way, the toner can be removed completely from the surface of the intermediate transfer member 10 while toner often enters in the toner adhesion reduction layer 98 in the art. As a result, in the configuration of the first embodiment, the toner resided after transfer can be cleaned surely and an after-image and fixed adhesion can be prevented from occurring.

It is known that a time constant $\tau$ of a resistance is represented generally by $\tau$=(a permittivity of the resistance)×(a volume resistivity of the resistance). This is a time constant of a circuit that comprises a resistive component and a capacitive component of a resistance connected in parallel with each other. A time constant of the intermediate transfer member 10 can be modeled with regarding the above circuit as an equivalent circuit shown in FIG. 19.

Figure 19:
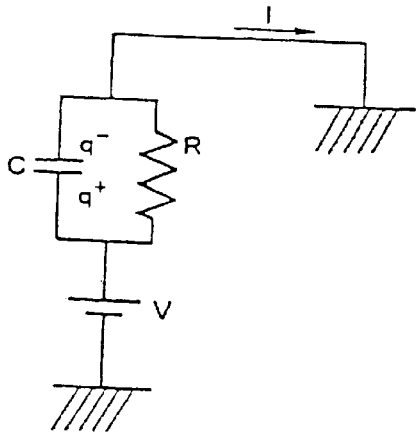
FIG. 19 is an equivalent circuit diagram of an intermediate transfer member.

In the model of FIG. 19, q denotes a charge accumulated on the belt surface of the intermediate transfer member. V denotes a potential difference between the upper and lower surfaces of the intermediate transfer member at that moment. I denotes a current flowing through the capacitance C and resistance R of the intermediate transfer member. They give:

$$q=C\cdot V \quad \text{(Equation 1)}$$

$$I=V/R \quad \text{(Equation 2)}$$

$$I=dq/dt \quad \text{(Equation 3)}$$

Arrangement of the above equations gives:

$$(1/q)\times dq/dt=1/(RC) \quad \text{(Equation 4)}$$

Solution of this equation for q by time gives:

$$q(t)=\exp(-t/RC) \quad \text{(Equation 5)}$$

Replacement of the above relation for a surface potential gives:

$$V(t)=\exp(-t/RC)/C \quad \text{(Equation 6)}$$

When t=RC, it becomes an initial potential difference 1/e immediately after the intermediate transfer member is charged.

A time required for attenuating V to 1/e, which is a time after a potential on the upper surface of the intermediate transfer member starts to decrease and until a potential difference between the potential on the upper surface and a potential on the lower surface comes to the initial state 1/e, corresponds to the time constant $\tau$=RC of the intermediate transfer member. C and R per unit area are represented by:

$$C=\epsilon\cdot\epsilon_0/d \quad \text{(Equation 7)}$$

where d denotes a thickness of the intermediate transfer member; $\rho_V$ a volume resistivity of the intermediate transfer member; $\epsilon$ a relative permittivity of the intermediate transfer member; and $\epsilon_0$ the vacuum permittivity. From the following equation:

$$R=\rho_V\cdot d \quad \text{(Equation 8)}$$

the time constant $\tau$ is represented by:

$$\tau=\rho_V\cdot\epsilon\cdot\epsilon_0 \quad \text{(Equation 9)}$$

Therefore, it is found that the time constant in the thickness direction of the intermediate transfer member is represented by $\tau$=(a permittivity of the intermediate transfer member)×(a volume resistivity of the intermediate transfer member).

Assume that the intermediate transfer member is charged on the surface occasionally affected from some cause. There are some factors that give charges on the intermediate transfer member. For example, a charge is generated from a friction with some component that is contained in a machine. A charge is also generated by a discharge from a corona charger or a discharge brush. A charge is further generated from contact with a conductive member such as a roller and a plate. These examples include a case of charging toner before the secondary transfer to improve an efficiency of transfer with an increased Q/M, for example. In another case, a corona charger or a discharge brush is employed to charge the toner resided after the secondary transfer before the intermediate transfer member is cleaned to equate the polarity for achieving an easy cleaning. In addition, even when the intermediate transfer member just winds around the conductive roller, a phenomenon of frictional charge is observed, which imparts a charge on the surface. This charge often causes a transfer defect.

As described above, the charge on the surface of the intermediate transfer member causes a large problem when the toner image moves. The toner moves when an electric field effects. An intensity of the electric field is determined from a potential difference between the back surface of the intermediate transfer member and a surface opposite thereto, for example, a simple tube of the image carrier or a core metal of the secondary transfer roller. If the intermediate transfer member is charged, its effect is large. It is better if the intermediate transfer member is charged uniformly over the surface, but actually, charge variations may often be caused on the surface of the intermediate transfer member. In the latter case, transfer variations occur partly. Accordingly, when $T_0$ denotes a time period after the intermediate transfer member is charged on the surface until the next movement step of the toner starts, if $T_0>\tau$, the potential on the upper surface of the intermediate transfer member sufficiently attenuates and less affects the movement of the toner. When $L_0$ denotes a length on the surface of the intermediate transfer member, and $V_L$ denotes a moving velocity of the surface of the intermediate transfer member, after the intermediate transfer member is charged on the surface affected from some cause until the next movement of the toner starts, $T_0$ is represented by $L_0/V_L$, and the following equation is satisfied:

$$L_0/V_L>\rho_V\cdot\epsilon\cdot\epsilon_0 \quad \text{(Equation 10)}$$

As described in the twenty-seventh aspect of the present invention, setting of the volume resistivity, relative permittivity, moving velocity and distance of the intermediate transfer member to satisfy the Equation 10 can prevent the toner image from being disturbed by the charge on the surface of the intermediate transfer member at the time of transferring. Similarly, as described in the twenty-eighth aspect, in the tandem transfer type of repeatedly performing the primary transfer, setting of a distance between image carriers can prevent the toner image from being disturbed by the charge on the surface of the intermediate transfer member at the time of transferring. Similarly, as described in the twenty-ninth aspect, setting of a distance from the final primary transfer location to a secondary transfer location can prevent the toner image from being disturbed by the charge on the surface of the intermediate transfer member at the time of transferring. Similarly, as described in the thirtieth aspect, setting of a distance from a secondary transfer location to a cleaning location of the intermediate transfer member can prevent the toner image from being disturbed by the charge on the surface of the intermediate transfer member at the time of transferring. Similarly, by the thirty-first aspect, setting of a distance from a cleaning location of the intermediate transfer member again to the primary transfer location of the first color for superimposing colors on the intermediate transfer member can prevent the toner image from being disturbed by the charge on the belt surface at the time of transferring.

Properties required for the intermediate transfer member are computed on trial based on the embodiment of FIG. 4, in which four image carriers contact the intermediate transfer member. These image carriers have the same distance therebetween, which is equal to $L_1$=120 mm. A distance between a contact portion at which the final image carrier contacts the intermediate transfer member and a secondary transfer location is equal to $L_2$=190 mm. A distance between the secondary transfer location and the cleaning portion is equal to $L_3$=245 mm. A distance between the cleaning portion and the contact portion to the first image carrier is equal to $L_4$=95 mm.

Among the above conditions, the shortest L is the distance $L_4$ from the cleaning portion to the first image carrier as described in the twenty-seventh aspect and a nice image may be obtained if the following equation is satisfied:

$$L_4V_L > \rho_V \cdot \epsilon \cdot \epsilon_0 \quad \text{(Equation 11)}$$

In FIG. 4, a seamless belt is employed as the intermediate transfer member, which is composed of a sheet of fluororesin with a relative permittivity of $\epsilon=8$, a thickness of 150 $\mu$m and a circumferential length of 1060 mm. Preparing such intermediate transfer members with different resistances, a measurement was performed for them regarding a volume resistivity $\rho_V$ and a surface resistivity $\rho_S$ using a measurement device available from Mitsubishi Chemical Inc. (Trade name: High-rester, Probe: HRS). One of the intermediate transfer members, A, was found to have a volume resistivity $\rho_V=1\times10^{11}$ to $5\times10^{21}$ Ωcm and a surface resistivity $\rho_S=1\times10^{9}$ to $1\times10^{10}$ Ω/□ (Applied voltage: 500 V, Timer: 10 sec). The other of the intermediate transfer members, B, was found to have a volume resistivity $\rho_V=5\times10^{12}$ to $1\times10^{13}$ Ωcm and a surface resistivity $\rho_S=5\times10^{10}$ to $1\times10^{12}$ Ω/□ (Applied voltage: 500 V, Timer: 10 sec). The machine is adjusted to have such an operation speed that allows the intermediate transfer member to have a line velocity of $V_L$=360 mm. Images were printed under such the condition, resulting for the intermediate transfer member A in a relatively good image, but for the intermediate transfer member B in a poor primary transfer rate, which is gradually reduced as colors are superimposed. In addition, tiny spot patterns were observed whole.

In the above condition, $L_4V_L=0.26$, $\rho_V\cdot\epsilon\cdot\epsilon_0=0.071$ to 0.354 for the intermediate transfer member A and $\rho_V\cdot\epsilon\cdot\epsilon_0=3.54$ to 7.1 for the intermediate transfer member B. Accordingly, the intermediate transfer member A is generally contained within the condition defined in the present invention. In contrast, the intermediate transfer member B greatly departs from the condition described in the present invention and consequently needs some policies to obtain a nice image.

The tandem image forming apparatus 20 of the present invention is not limited to the embodiment shown in FIG. 4 that arranges the monocolor image forming unit 18 in the order of yellow, cyan, magenta and black. Rather, it is applicable to an embodiment that arranges them in an order of black, yellow, magenta and cyan as shown in FIG. 20.

Figure 20:
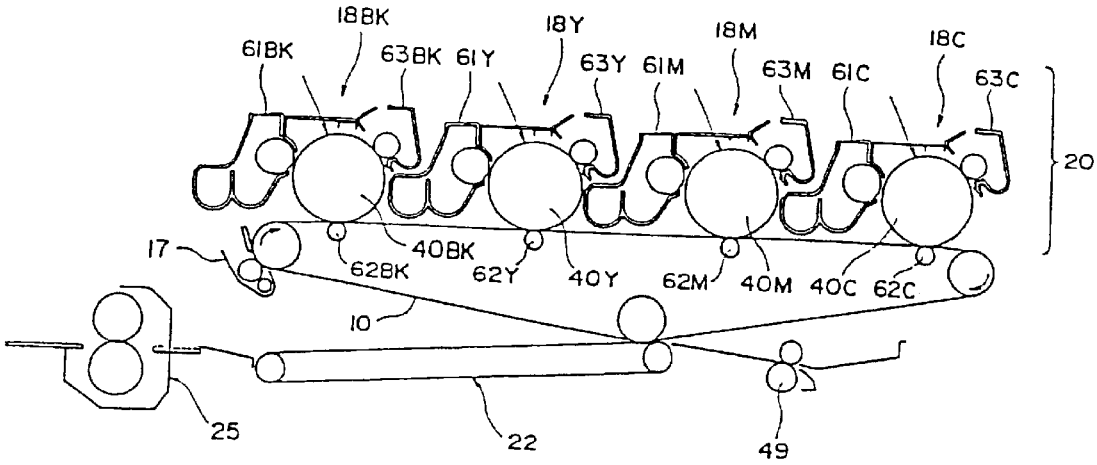
FIG. 20 shows another example of monocolor image forming unit arrayed in the tandem image forming apparatus shown in FIG. 4.
Figure 21:
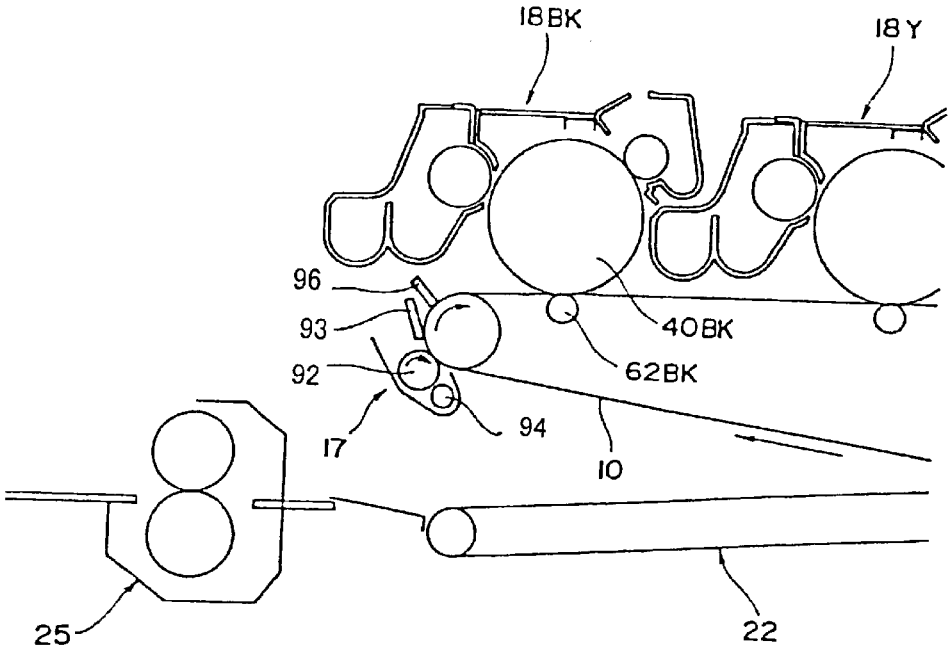
FIG. 21 is an enlarged view showing the configuration shown in FIG. 20.

In the tandem image forming apparatus 20 shown in FIG. 20, an intermediate transfer member cleaning device 17 may be provided with a fur brush 92 and a cleaning blade 93 as cleaning members as shown in FIG. 21. The fur brush 92 contacts an intermediate transfer member 10 and rotates in the counter direction relative to the intermediate transfer member. The cleaning blade 93 on the other hand is located at a location downstream from the fur brush 92, supporting the base end and pressing the tip end against the intermediate transfer member 10. The reference numeral 94 shown in FIG. 21 denotes a coil- or screw-shaped, toner conveying member.

Residual toner resided after the secondary transfer on the intermediate transfer member 10 is removed with the fur brash 92 and the cleaning blade 93 as the intermediate transfer member 10 rotates. The removed toner is conveyed on the toner conveying member 94 to a waste toner bottle, not shown.

Also in the configuration shown in FIG. 21, the block of bound particles 96 may be located downstream from the intermediate transfer member cleaning device 17. As the intermediate transfer member 10 rotates, the block of bound particles 96 attaches particles on the block to form a toner adhesion reduction layer 98 consisting of particles 97 adhered on the surface of the intermediate transfer member 10.

A second embodiment of the present invention will be described next. In an image forming apparatus of the second embodiment, an intermediate transfer member may comprise, in addition to an intermediate transfer belt, an intermediate transfer drum. A configuration herein described comprises the intermediate transfer belt as an example. An image carrier illustratively comprises a photosensitive member.

Figure 22:
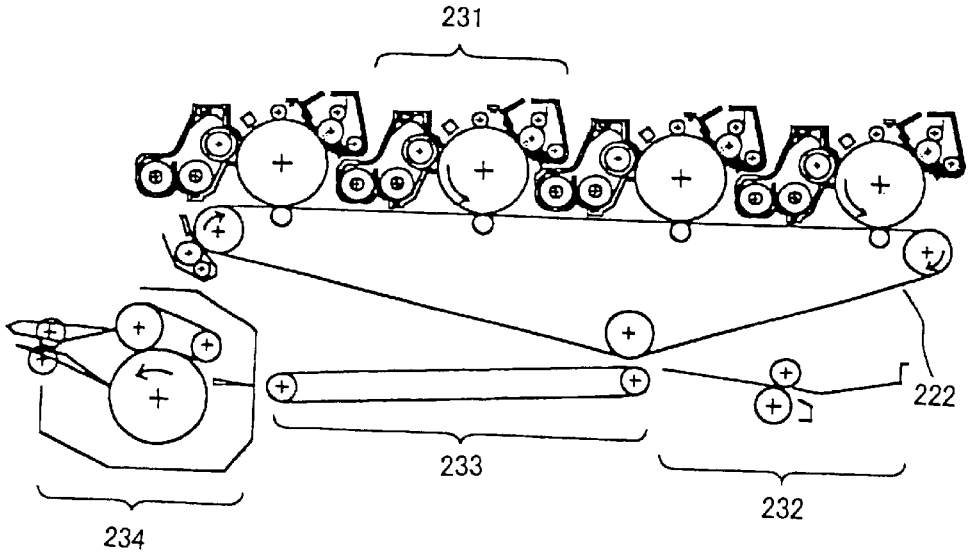
FIG. 22 illustrates an arrangement of a second embodiment of the present invention.

FIG. 22 is a general diagram of a configuration example of the second embodiment of the present invention, showing an internal mechanism of the image forming apparatus of the second embodiment or a color laser printer. A body of the color laser printer comprises an image processing unit, an image writing unit, an image forming unit and a paper feeder, which are employed to form a color image of the xerography type as publicly known in the art.

FIG. 22 shows a plurality of developing units 231 arranged along an intermediate transfer belt 222, a paper feeder 232 for feeding a recording medium (paper) to a secondary transfer device 233, and a fixing device 14 for fixing an image transferred by the secondary transfer device 233 to the recording paper. The above configuration corresponds to the configuration of the image forming unit and paper feeder.

The image forming apparatus of the second embodiment comprises a toner adhesion reduction layer on the surface of the intermediate transfer member 10 similar to the configuration described in FIG. 14 for the first embodiment.

The image processing unit executes an image processing based on image signals. This processing converts the image signals into color signals for image formation of black (BK) yellow (Y), magenta (M) and cyan (C), which are sent to the image writing unit. The image writing unit comprises a laser scanning optical system, for example, that includes a laser source, a deflector such as a rotary polygonal mirror, a scan-focusing optical system and a group of mirrors. Alternatively, it may comprise an LED writing system that includes an LED array consisting of a lot of LEDs arrayed one- or two-dimensionally and a focusing optical system. Such the image writing unit has four writing optical paths respectively corresponding to the above color signals to write images of respective color signals on photosensitive drums BK, Y, M and C provided for respective colors in the image forming unit.

The image forming unit includes photosensitive materials BK, Y, M and C for black (BK), yellow (Y), magenta (M) and cyan (C). The image forming materials for respective colors generally comprise OPC photosensitive materials. Located on the periphery of each photosensitive material are a charger, an exposing unit corresponding to the laser light from the image writing unit, developing devices, transfer devices, cleaning devices and charge erasers for respective colors of black, yellow, magenta and cyan. The developing device employs a two-component magnetic brush system.

The intermediate transfer belt 2 is located in between each of the photosensitive materials BK, Y, M, C and each of the transfer devices. Toner images of respective colors are transferred and superimposed in turn from the respective photosensitive materials to the intermediate transfer belt to retain developed toner images on the photosensitive materials. After the intermediate transfer belt 2 passes through the final image forming unit, a color image with four superimposed colors is formed on the intermediate transfer belt 222.

The recording medium (paper) is fed from the paper feeder and introduced into the second transfer unit via a resist roller. An image is transferred to the recording medium at a location where the intermediate transfer belt 222 contacts the secondary transfer member 233. The recording medium after the image transfer is transported to a fixing device 234, where the image is fixed to obtain a color image. After the image is transferred to the recording medium, the intermediate transfer belt is subjected to the intermediate transfer belt cleaning device located downstream from the secondary transfer location to remove residual toner resided after transfer and the next image is formed again by the image forming device.

Figure 23:
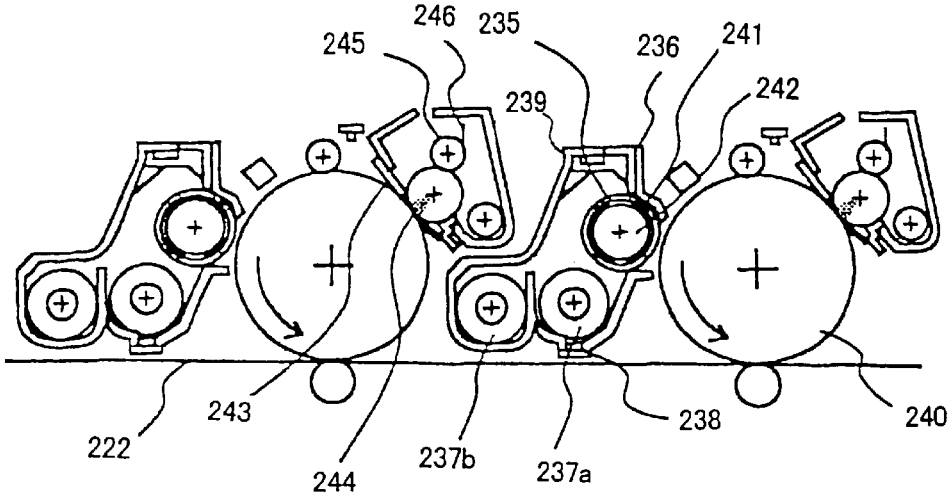
FIG. 23 shows an outlined configuration of a developing unit 231 shown in FIG. 22.
Figure 24:
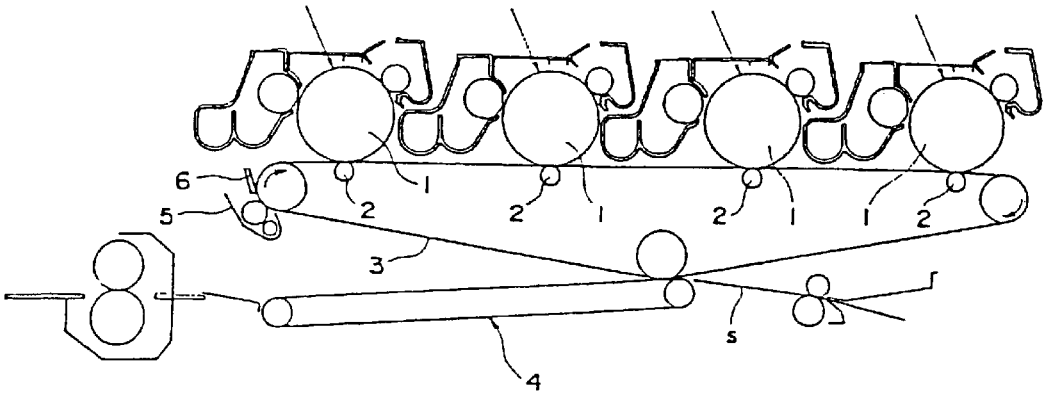
FIG.24 RELATED ART
FIG. 24 illustrates a conventional image forming apparatus for preventing an after-image from occurring.

FIG. 23 shows a general configuration of a developing unit 231. The developing unit 231 comprises a developing roller 235, a doctor blade 236, screws 237*a*, 237*b*, a toner density sensor 238 and an outer casing 239. The screws 237*a* and 237*b* are located at a location obliquely beneath the developing roller 15. The screw 237*a* is arranged in parallel with the screw 237*b* in the horizontal direction. The outer casing 239 includes a partition that defines two chambers to separate the screw 237*a* from the screw 237*b*. The partition has two notches at the far and near sides for allowing the developer to circulate in between the screws 237*a* and 237*b*. The outer casing 239 has an opening at a portion opposite to a photosensitive drum 240. This opening is employed to expose a part of the developing roller 235 therethrough.

As shown in FIG. 23, the outer casing 239 contains a slightly larger space aside the developing roller 235 above the screw 27*a* to surround the developing roller 25, screws 237*a*, 237*b* and doctor blade 236. The developing roller 235 comprises a rotatable, non-magnetic developing sleeve 241 and a magnetic field generating unit or a magnet 242 secured inside the sleeve.

The developer comprises a two-component developer consisting of a non-magnetic toner and a magnetic carrier. Agitated and transported by the two screws 237*a* and 237*b* that have opposite transport directions, the developer always circulates in the two chambers. The agitated, transported and circulating developer is fed by the screw 237*a* to the developing sleeve 241 and, by the magnetic force from the magnet 242, retained in the form of a magnetic brush and lifted up in the rotational direction of the developing sleeve 241. The lifted developer in the form of the magnetic brush is trimmed by the doctor blade 236 into an appropriate amount and sent to the developing unit facing to the photosensitive drum 240. The developer remained after trimmed by the doctor blade 236 drops outside the surface of the developing sleeve 241 by gravity and returns to the screw 237*a*, which repeatedly feeds the developer to the developing sleeve 241 while agitating and transporting it.

On the other hand, with respect to the developer sent to the developing unit, the toner migrates to a latent image on the photosensitive drum 240 to develop the image. The developer not used for development returns inside the outer casing 239, separates from the developing sleeve 241 at a portion not effected by the magnetic force from the magnet 242, and is collected by the screw 237*a*. As described, agitated and transported by the screws 237*a* and 237*b*, the circulating developer is supplied to and collected at the developing sleeve 241. Repeated image outputs would decrease the toner density, which is sensed by the toner density sensor 238 in order to keep a constant density with a supplemental of toner.

The cleaning unit is described next. The cleaning unit is employed to remove toner resided on the photosensitive drum 240 after the first transfer. It comprises an elastic cleaning blade 243, a fur brush 244 or a combination thereof. In the present invention, the cleaning unit comprises a cleaning blade 243 composed of an elastic material such as a polyurethane rubber, a conductive fur brush 244, a metallic electric-field roller 245 located in contact with the fur brush 244, a scraper 246 for the electric-field roller 245 and a collecting screw, not shown.

As for operations, first the fur brush 244, rotating counter in the direction opposite to the rotational direction of the photosensitive drum 240, scrapes away the residual toner on the photosensitive drum 240. The electric-field roller 245, rotating counter relative to the fur brush 244, removes the toner attached on the fur brush 244. The scraper 246 cleans the electric-field roller 245. As a bias is applied to the electric-field roller 245, an electrostatic force moves the toner from the photosensitive drum 240 to the fur brush 244, then from the fur brush 244 to the electric-field roller 245. The toner is finally scraped off the electric-field roller 245 by the scraper 246 and collected via a collecting screw, not shown, into a waste toner bottle, not shown. Alternatively, the toner is returned to the developing unit 231 for the recycled use.

In a positional relation between the cleaning unit and the developing unit 231, a portion of the collecting screw in the cleaning unit is superimposed on the outer casing 239 located above the screw 237*b* of the developing unit 231.

As described in the first embodiment, it is known that a time constant $\tau$ of a resistance is represented generally by $\tau$=(a permittivity of the resistance)×(a volume resistivity of the resistance). This is a time constant of a circuit that comprises a resistive component and a capacitive component of a resistance connected in parallel with each other. A time constant of the intermediate transfer member 10 can be modeled with regarding the above circuit as an equivalent circuit shown in FIG. 19.

In the model of FIG. 19, q denotes a charge accumulated on the belt surface of the intermediate transfer belt. V denotes a potential difference between the upper and lower surfaces of the intermediate transfer belt at that moment. I denotes a current flowing through the capacitance C and resistance R of the intermediate transfer belt. The equations (1) to (9) can be solved in the same manner as the first embodiment. Accordingly, when $T_0$ denotes a time period after the intermediate transfer belt is charged on the surface until the next movement step of the toner starts, if $T_0>\tau$, the potential on the upper surface of the intermediate transfer belt sufficiently attenuates and less affects the movement of the toner.

When $L_0$ denotes a length of the surface of the intermediate transfer belt and $V_L$ denotes a moving velocity of the surface of the intermediate transfer belt, after the intermediate transfer belt is charged on the surface affected from some cause until the next movement of the toner starts, $T_0$ is represented by $L_0/V_L$, and the following condition represented by the above described equation (10) is obtained:

$$L_0/V_L>\rho_V\cdot\epsilon\cdot\epsilon_0 \quad \text{(Equation 10)}$$

Also in the second embodiment, as described in the thirty-eighth aspect of the present invention, setting of the volume resistivity, relative permittivity, moving velocity and distance of the intermediate transfer belt to satisfy the Equation 10 can prevent the toner image from being disturbed by the charge on the surface of the intermediate transfer belt at the time of transferring.

Similarly, as described in the thirty-ninth aspect, in the tandem transfer type for repeatedly performing the primary transfer, setting of a distance between image carriers can prevent the toner image from being disturbed by the charge on the surface of the intermediate transfer belt at the time of transferring.

Similarly, as described in the fortieth aspect, setting of a distance from the final primary transfer location to a secondary transfer location can prevent the toner image from being disturbed by the charge on the surface of the intermediate transfer belt at the time of transferring.

Similarly, as described in the forty-first aspect, setting of a distance from a secondary transfer location to a cleaning location of the intermediate transfer belt can prevent the toner image from being disturbed by the charge on the surface of the intermediate transfer belt at the time of transferring.

Similarly, by the forty-second aspect, setting of a distance from a cleaning location of the intermediate transfer belt again to the primary transfer location of the first color for superimposing colors on the intermediate transfer belt can prevent the toner image from being disturbed by the charge on the belt surface at the time of transferring.

Properties required for the intermediate transfer belt are computed on trial based on the configuration shown in FIG. 22, in which four image carriers contact the intermediate transfer belt. These image carriers have the same distance therebetween, which is equal to $L_1$=120 mm. A distance between a contact portion at which the final image carrier contacts the intermediate transfer belt and a secondary transfer location is equal to $L_2$=190 mm. A distance between the secondary transfer location and the cleaning device is equal to $L_3$=245 mm. A distance between the cleaning portion and the contact portion of the first image carrier is equal to $L_4$=95 mm.

Among the above conditions, the shortest L is the distance $L_4$ from the cleaning portion and to the first image carrier as described in the thirty-eighth aspect and a nice image may be obtained if the following equation is satisfied:

$$L_4 V_L > \rho_V \cdot \epsilon \cdot \epsilon_0 \quad \text{(Equation 11)}$$

In FIG. 22, a seamless belt is employed as the intermediate transfer member, which is composed of a sheet of fluororesin with a relative permittivity of $\epsilon$=8, a thickness of 150 $\mu$m and a circumferential length of 1060 mm. Preparing such intermediate transfer belts with different resistances, a measurement was performed for them regarding a volume resistivity $\rho_V$ and a surface resistivity $\rho_S$ using a measurement device available from mitsubishi Chemical Inc. (Trade name: High-rester, Probe: HRS). One of the intermediate transfer belts, A, was found to have a volume resistivity $\rho_V=1\times10^{11}$ to $5\times10^{11}$ Ωcm and a surface resistivity $\rho_S=1\times10^{2}$ to $1\times10^{11}$ Ω/□ (Applied voltage: 500 V, Timer: 10 sec). The other of the intermediate transfer belt, B, was found to have a volume resistivity $\rho_V=5\times10^{12}$ to $1\times10^{13}$ Ωcm and a surface resistivity $\rho_S=5\times10^{10}$ to $1\times10^{11}$ Ω/□ (Applied voltage: 500 V, Timer: 10 sec). The machine is adjusted to have such an operation speed that allows the intermediate transfer belt to have a line velocity of $V_L$=360 mm. Images were printed under such the condition, resulting for the intermediate transfer belt A in a relatively good image, but for the intermediate transfer belt B in a poor primary transfer rate, which is gradually reduced as colors are superimposed. In addition, tiny spot patterns were observed whole.

In the above condition, $L_4V_L$=0.26, $\rho_V\cdot\epsilon\cdot\epsilon_0$=0.071 to 0.354 for the intermediate transfer belt A and $\rho_V\cdot\epsilon\cdot\epsilon_0$=3.54 to 7.1 for the intermediate transfer belt B. Accordingly, the intermediate transfer belt A is generally contained within the condition defined in the present invention. In contrast, the intermediate transfer belt B greatly departs from the condition described in the present invention and consequently needs some policies to obtain a nice image.

As described above, according to the first aspect of the invention, in the image forming apparatus for forming a synthesized toner image, the monocolor image forming unit includes a developing device and an image carrier cleaning device arranged around an image carrier. In addition, the monocolor image forming unit includes a toner recycling device for conveying toner collected at the image carrier cleaning device to the developing device. Therefore, individual toner can be subjected to the recycled use.

Further, a plurality of the monocolor image forming unit is arrayed along the rotary transport direction of the intermediate transfer member to configure a tandem image forming device for forming a synthesized toner image on the intermediate transfer member. The synthesized toner image is then transferred on a recording medium to form an image. Namely, the image is formed on the recording medium via the intermediate transfer member. Therefore, the recording medium can not contact the image carrier directly. This configuration can prevent foreign matters such as paper powders and dusts attached on the recording medium from mixing into the recycled toner in order to prevent a quality of the image from lowering.

In addition, the transfer rate greatly depends on the resistance. Generally, the recording medium has a high moisture absorbency and a large resistance variation to environmental variations such as temperature and humidity. On the other hand, the intermediate transfer member is mainly composed of a material such as a resinous material with a larger resistance than the recording medium and therefore has a smaller resistance variation to the environmental variations. Thus, as the first aspect of the invention, the image formation that indirectly transfers the image to the recording medium via the intermediate transfer member can reduce the resistance variation to the environmental variations and stabilize the transfer rate, compared to the direct transfer that directly transfers the image to the recording medium.

According to the first aspect of the invention, a combination of the tandem image forming device, intermediate transfer member and toner recycling device can further achieve the following effects.

1) In the system that includes the tandem image forming device for transferring the toner image formed on the image carrier directly to the recording medium, there is a problem of the transfer dispersion due to the step-up of the transfer voltage. To the contrary, the intermediate transfer system using the intermediate transfer member can be applied to reduce the transfer voltage and prevent the transfer dispersion from occurring.

2) The application of the intermediate transfer system lowers the speed, though it can be increased to improve the yield by the application of the tandem system with the tandem image forming device, especially in a multicolor image forming apparatus.

3) The application of the intermediate transfer system can increase the transfer rate and reduce the amount of the recycled toner, especially in a multicolor image forming apparatus.

4) The application of the toner recycling system can contribute to maintain the social environments, especially reducing the waste toner.

According to the second aspect of the invention, such the effects can be achieved in the color image forming apparatus.

According to the third aspect of the invention, in the tandem image forming device in the color image forming apparatus, the monocolor image forming unit located upstream-most in the rotary transport direction of the intermediate transfer member includes the toner recycling device. Therefore, the effects according to the first aspect of the invention can be achieved without possible color mixture while using the recycled toner.

According to the fourth aspect of the invention, among the plurality of monocolor image forming unit at least a black monocolor image forming unit includes the toner recycling device. Therefore, the effects according to the first aspect of the invention can be achieved while preventing foreign matters from mixing into the recycled toner, preventing the image quality from lowering, and using the recycled black toner with less image degradation.

According to the fifth aspect of the invention, in the tandem image forming device in the color image forming apparatus, the black monocolor image forming unit is located downstream-most in the rotary transport direction of the intermediate transfer member. Therefore, the effects according to the first aspect of the invention can be achieved while preventing the toner from degrading as far as possible even if another color is mixed.

According to the sixth aspect of the invention, the effects according to the first aspect of the invention can be achieved in the two-color image forming apparatus.

According to the seventh aspect of the invention, the effects according to the first aspect of the invention can be achieved in the image forming apparatus of the type, in which the image carrier comprises a drum and the intermediate transfer member comprises a belt.

According to the eighth aspect of the invention, the effects according to the first aspect of the invention can be achieved in the image forming apparatus of the type, in which the image carrier and the intermediate transfer member both comprise respective belts.

According to the ninth aspect of the invention, in the image forming apparatus for forming a synthesized toner image, the apparatus further comprises a process cartridge integrally attached to and detached from the body of the image forming apparatus. The process cartridge includes at least the image carrier. Therefore, the effects according to the first aspect of the invention can be achieved while improving the maintenance property.

According to the tenth aspect of the invention, in the monocolor image forming unit in the image forming apparatus for forming a synthesized toner image, the monocolor image forming unit includes a toner recycling device for conveying toner collected at the image carrier cleaning device to the developing device. A plurality of the monocolor image forming unit is arrayed along the rotary transport direction of the intermediate transfer member to configure a tandem image forming device. The tandem image forming device is employed for forming a synthesized toner image on the intermediate transfer member, and transferring the synthesized toner image to the recording medium to form an image thereon. Therefore, the same effects as those according to the first aspect of the invention can be achieved.

According to the eleventh aspect of the invention, in the image forming apparatus for forming a synthesized toner image, a plurality of the monocolor image forming unit is arrayed along the rotary transport direction of the intermediate transfer member to configure a tandem image forming device. The tandem image forming device is employed for forming a synthesized toner image on the intermediate transfer member, and transferring the synthesized toner image to the recording medium to form an image thereon. The monocolor image forming unit is provided with a toner recycling device for conveying toner collected at the image carrier cleaning device to the developing device. Therefore, the same effects as those according to the first aspect of the invention can be achieved.

According to the twelfth aspect of the invention, in the monocolor image forming apparatus, the monocolor image forming unit includes a developing device and an image carrier cleaning device arranged around an image carrier. In addition, the monocolor image forming unit includes a toner recycling device for conveying toner collected at the image carrier cleaning device to the developing device. Therefore, individual toner can be subjected to the recycled use.

The toner image on the image carrier is once transferred to the intermediate transfer member then transferred on a recording medium to form an image. Namely, the image is formed on the recording medium via the intermediate transfer member. Therefore, the recording medium can not contact the image carrier directly. This configuration can prevent foreign matters such as paper powders and dusts attached on the recording medium from mixing into the recycled toner in order to prevent a quality of the image from lowering.

In addition, the transfer rate greatly depends on the resistance. Generally, the recording medium has a high moisture absorbency and a large resistance variation to environmental variations such as temperature and humidity. On the other hand, the intermediate transfer member is mainly composed of material such as a resinous material with a larger resistance than the recording medium and therefore has a smaller resistance variation to the environmental variations. Thus, as the tenth aspect of the invention, the image formation that indirectly transfers the image to the recording medium via the intermediate transfer member can reduce the resistance variation to the environmental variations and stabilize the transfer rate, compared to the direct transfer system that directly transfers the image to the recording medium.

According to the thirteenth aspect of the invention, such the effects according to the twelfth aspect of the invention can be achieved in the image forming apparatus of the type, in which the image carrier comprises a drum and the intermediate transfer member comprises a belt or drum.

According to the fourteenth aspect of the invention, the above effects according to the twelfth aspect of the invention can be achieved in the image forming apparatus of the type, in which the image carrier comprises a belt and the intermediate transfer member comprises a belt or drum.

According to the fifteenth aspect of the invention, in the monocolor image forming apparatus, the apparatus further comprises a process cartridge integrally attached to and detached from the body of the image forming apparatus. The process cartridge includes at least the image carrier. Therefore, the effects according to the twelfth aspect of the invention can be achieved while improving the maintenance property.

According to the sixteenth aspect of the invention, in the monocolor image forming unit in the monocolor image forming apparatus, a toner image formed on the image carrier is transferred via an intermediate transfer member to a recording medium. The monocolor image forming unit is provided with a toner recycling device for conveying toner collected at the image carrier cleaning device to the developing device. Therefore, the same effects as those according to the twelfth aspect of the invention can be achieved.

According to the seventeenth aspect of the invention, in the monocolor image forming apparatus, a toner image formed on the image carrier is transferred once to an intermediate transfer member, then the toner image on the intermediate transfer member is transferred to a recording medium. The monocolor image forming unit is provided with a toner recycling device for conveying toner collected at the image carrier cleaning device to the developing device. Therefore, the same effects as those according to the twelfth aspect of the invention can be achieved.

According to the eighteenth aspect of the invention, in the image forming apparatus, a developing bias voltage is applied on the developing device to generate an alternative electric field at the time of development. Therefore, the effects according to the first or twelfth aspect of the invention can be achieved. In addition, the vibration bias voltage consisting of a DC voltage and an AC voltage superimposed thereon is applied to prevent uncharged or insufficiently charged impurities from attaching on the image carrier in order to further prevent the image quality from lowering.

According to the nineteenth aspect of the invention, the image forming apparatus employs toner that contains a release agent. Therefore, the effects according to the first or twelfth aspect of the invention can be achieved. In addition, it is possible to prevent the toner from being pulverized frictionally in order to further prevent the image quality from lowering.

According to the twentieth aspect of the invention, in the image forming apparatus, toner with a roundness of 90 or more is employed. Therefore, the effects according to the first or twelfth aspect of the invention can be achieved. In addition, it is possible to smoothen the surface feature of the toner to improve the toner transfer rate and reduce the amount of the recycled toner, thereby preventing an image quality from degrading in order to further prevent the image quality from lowering.

According to the twenty-first aspect of the invention, in the image forming apparatus, such toner is employed that has a half-value width of 2.2 [fC/10 $\mu$m] or less in a distribution curve of (toner charge)/(toner particle diameter). Therefore, the effects according to the first or twelfth aspect of the invention can be achieved. In addition, it is possible to maintain the distribution curve sharp to keep the toner component ratio constant at the time of recycling the toner, thereby preventing an image quality from degrading in order to further prevent the image quality from lowering.

According to the twenty-second aspect of the invention, in the image forming apparatus, the intermediate transfer member includes an elastic layer. Therefore, the effects according to the first or twelfth aspect of the invention can be achieved. In addition, it is possible to contact the intermediate transfer member tightly with the image carrier to improve the toner transfer rate in order to further prevent the image quality from lowering.

According to the twenty-third aspect of the invention, in the intermediate transfer member, a toner adhesion reduction layer for reducing an adhesion of toner is formed uniformly over a surface thereof. As a result, the toner cannot contact directly the intermediate transfer member and the cleaning performance can be improved without degradation of the surface of the intermediate transfer member. Therefore, the effects according to the first or twelfth aspect of the invention can be achieved while preventing the after-image and fixed toner adhesion from occurring.

According to the twenty-fourth aspect of the invention, the toner adhesion reduction layer is composed of zinc stearate. The zinc stearate, to be charged with the opposite polarity, facilitates the attachment to the toner and reduces the toner adhesion to the intermediate transfer member, thereby preventing the toner from attaching directly to the intermediate transfer member. Therefore, the effects according to the first or twelfth aspect of the invention can be achieved while improving the cleaning performance and preventing the after-image and fixed toner adhesion from occurring.

According to the twenty-fifth aspect of the invention, the toner adhesion reduction layer is composed of fluororesin. Therefore, the effects according to the first or twelfth aspect of the invention can be achieved while increasing the release property between the surface of the intermediate transfer member and the toner, improving the cleaning performance and preventing the after-image and fixed toner adhesion from occurring.

According to the twenty-sixth aspect of the invention, the toner adhesion reduction layer is composed of particles scraped off a block of bound particles using a brush and adhered to the intermediate transfer member. Therefore, the effects according to the first or twelfth aspect of the invention can be achieved while easily improving the cleaning performance and preventing the after-image and fixed toner adhesion from occurring without degradation of the surface of the intermediate transfer member.

According to the twenty-seventh aspect of the invention, the effects according to the first or twelfth aspect of the invention can be achieved. In addition, even when the surface of the intermediate transfer member is charged occasionally from some influence, it is possible to relieve the charge on the intermediate transfer member so as not to prevent the toner from moving. This can be completed until reaching to the process step of moving the toner on the intermediate transfer member, such as the primary transfer, the secondary transfer and the cleaning of the toner on the intermediate transfer member. It is also possible to provide a good image with no special equipment required.

According to the twenty-eighth aspect of the invention, the effects according to the first or twelfth aspect of the invention can be achieved. In addition, during the intermediate transfer member moves from the primary transfer location to the next primary transfer location, the charge moved to the surface of the intermediate transfer member attenuates to 1/e or below. Therefore, it is possible to sufficiently eliminate the potential history on the intermediate transfer member. Thus, when toner images are transferred and superimposed on the intermediate transfer member, it is possible to prevent the image from being disturbed and the transfer efficiency from lowering. It is also possible to provide a good image with no special equipment required.

According to the twenty-ninth aspect of the invention, the effects according to the first or twelfth aspect of the invention can be achieved. In addition, during the intermediate transfer member moves from the final primary transfer location for superimposing colors to the secondary transfer location, the charge moved to the surface of the intermediate transfer member attenuates to 1/e or below. Therefore, it is possible to sufficiently eliminate the potential history on the intermediate transfer member. Thus, when the toner image is transferred from the intermediate transfer member to the recording medium, it is possible to prevent the image from being disturbed and the transfer efficiency from lowering.

According to the thirtieth aspect of the invention, the effects according to the first or twelfth aspect of the invention can be achieved. In addition, during the intermediate transfer member moves from the secondary transfer location to the intermediate transfer member cleaning location, the charge generated on the surface of the intermediate transfer member attenuates to 1/e or below. Therefore, it is possible to sufficiently eliminate the potential history on the intermediate transfer member. Further, since the charge of the residual toner stayed on the intermediate transfer member during the toner image transfer to the recording medium can be reduced sufficiently, it is possible to prevent the efficiency of the intermediate transfer member cleaning from lowering.

According to the thirty-first aspect of the invention, the effects according to the first or twelfth aspect of the invention can be achieved. In addition, during the intermediate transfer member moves from the intermediate transfer member cleaning location to the primary transfer location, the charge moved to the surface of the intermediate transfer member attenuates to 1/e or below. Therefore, it is possible to sufficiently eliminate the potential history on the intermediate transfer member. Further, when the toner image is transferred from the image carrier to the intermediate transfer member, the toner image is not disturbed by the electric field.

According to the thirty-second aspect of the invention, in the intermediate transfer member, a toner adhesion reduction layer for reducing an adhesion of toner is formed uniformly over a surface thereof. Therefore, the toner can not contact directly the intermediate transfer member and the cleaning performance can be improved without degradation of the surface of the intermediate transfer member while preventing the after-image and fixed toner adhesion from occurring.

According to the thirty-third aspect of the invention, in such the intermediate transfer member, the toner adhesion reduction layer is composed of zinc stearate. The zinc stearate, to be charged with the opposite polarity, facilitates the attachment to the toner and reduces the toner adhesion to the intermediate transfer member, thereby preventing the toner from attaching directly to the intermediate transfer member. Therefore, it is possible to improve the cleaning performance and prevent the after-image and fixed toner adhesion from occurring.

According to the thirty-fourth aspect of the invention, in the intermediate transfer member according to the first aspect, the toner adhesion reduction layer is composed of fluororesin. Therefore, it is possible to increase the release property between the surface of the intermediate transfer member and the toner, improve the cleaning performance and prevent the after-image and fixed toner adhesion from occurring.

According to the thirty-fifth aspect of the invention, the image forming apparatus comprises the intermediate transfer member according to the first, second or third aspect. Therefore, it is possible to provide an image forming apparatus that comprises the intermediate transfer member with the above effects.

According to the thirty-sixth aspect of the invention, the toner adhesion reduction layer is composed of particles adhered to the intermediate transfer member when the block of bound particles is pressed against the intermediate transfer member rotating. Therefore, it is possible to provide a xerography apparatus capable of easily improving the cleaning performance and preventing the after-image and fixed toner adhesion from occurring without degradation of the surface of the intermediate transfer member.

According to the thirty-seventh aspect of the invention, the block of bound particles is pressed with a controllable force. Therefore, it is possible to provide a xerography apparatus capable of always forming a uniform toner adhesion reduction layer on the intermediate transfer member, further improving the cleaning performance and preventing the after-image and fixed toner adhesion from occurring without degradation of the surface of the intermediate transfer member.

According to the thirty-eighth aspect of the invention, in this image forming apparatus, even when the surface of the intermediate transfer member is charged occasionally from some influence, it is possible to relieve the charge on the intermediate transfer member so as not to prevent the toner from moving. This can be completed until reaching to the process step of moving the toner on the intermediate transfer member, such as the primary transfer, the secondary transfer and the cleaning of the toner on the intermediate transfer member. It is also possible to provide a good image with no special equipment required. Therefore, it is possible to provide an image forming apparatus capable of obtaining a nice image with low cost and less transfer dispersion, defining a length of the intermediate transfer belt, a moving velocity of the intermediate transfer belt, a permittivity of the intermediate transfer belt and a volume resistivity even when it is applied to the image forming apparatus of the tandem intermediate transfer type.

According to the thirty-ninth aspect of the invention, during the intermediate transfer member moves from a contact opposing location between the image carrier and the intermediate transfer member to the next contact opposing location between the image carrier and the intermediate transfer member, the charge moved to the surface of the intermediate transfer member at the first contact opposing location attenuates to 1/e or below. Therefore, it is possible to sufficiently eliminate the potential history on the intermediate transfer member. Thus, when toner images are transferred and superimposed on the intermediate transfer member, it is possible to prevent the image from being disturbed and the transfer efficiency from lowering. It is also possible to provide a good image with no special equipment required. Therefore, it is possible to provide an image forming apparatus capable of obtaining a nice image with low cost and less transfer dispersion, defining a length of the intermediate transfer belt, a moving velocity of the intermediate transfer belt, a permittivity of the intermediate transfer belt and a volume resistivity even when it is applied to the image forming apparatus of the tandem intermediate transfer type.

According to the fortieth aspect of the invention, during the intermediate transfer member moves from the final contact opposing location between the image carrier and the intermediate transfer member for superimposing colors to the location for transferring the toner image from the intermediate transfer member to the recording paper, the charge moved to the surface of the intermediate transfer member at the contact opposing location attenuates to 1/e or below. Therefore, it is possible to sufficiently eliminate the potential history on the intermediate transfer member. Thus, when the toner image is transferred from the intermediate transfer member to the recording paper, it is possible to prevent the image from being disturbed and the transfer efficiency from lowering. Therefore, it is possible to provide an image forming apparatus capable of obtaining a nice image with low cost and less transfer dispersion, defining a length of the intermediate transfer belt, a moving velocity of the intermediate transfer belt, a permittivity of the intermediate transfer belt and a volume resistivity even when it is applied to the image forming apparatus of the tandem intermediate transfer type.

According to the forty-first aspect of the invention, at the portion of transferring the toner image from the intermediate transfer member to the recording paper, the charge generated on the surface of the intermediate transfer member attenuates to 1/e or below. Therefore, it is possible to sufficiently eliminate the potential history on the intermediate transfer member. Further, since the charge of the residual toner stayed on the intermediate transfer member during the toner image transfer to the recording paper can be reduced sufficiently, it is possible to prevent the efficiency of the intermediate transfer member cleaning from lowering. Therefore, it is possible to provide an image forming apparatus capable of obtaining a nice image with low cost and less transfer dispersion, defining a length of the intermediate transfer belt, a moving velocity of the intermediate transfer belt, a permittivity of the intermediate transfer belt and a volume resistivity even when it is applied to the image forming apparatus of the tandem intermediate transfer type.

According to the forty-second aspect of the invention, during the intermediate transfer member moves from a cleaning location of the intermediate transfer member to a contact opposing location between the image carrier and the intermediate transfer member, at the cleaning portion, the charge moved to the surface of the intermediate transfer member attenuates to 1/e or below. Therefore, it is possible to sufficiently eliminate the potential history on the intermediate transfer member. Further, when the toner image is transferred from the image carrier to the intermediate transfer member, the toner image is not disturbed by the electric field. Therefore, it is possible to provide an image forming apparatus capable of obtaining a nice image with low cost and less transfer dispersion, defining a length of the intermediate transfer belt, a moving velocity of the intermediate transfer belt, a permittivity of the intermediate transfer belt and a volume resistivity even when it is applied to the image forming apparatus of the tandem intermediate transfer type.

The present document incorporates by reference the entire contents of Japanese priority documents, 2000-291425 filed in Japan on Sep. 26, 2000, 2000-342971 filed in Japan on Nov. 10, 2000, 2001-000984 filed in Japan on Jan. 9, 2001 and 2001-261211 filed in Japan on Aug. 22, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus, comprising monocolor image forming unit including a developing device and an image carrier cleaning device arranged around an image carrier, for transferring a toner image formed on the image carrier in the monocolor image forming unit once to an intermediate transfer member then transferring the toner image from the intermediate transfer member to a recording medium to form an image thereon, wherein a plurality of the monocolor image forming unit is arrayed along the rotary transport direction of the intermediate transfer member to configure a tandem image forming device for forming a multicolor image on the intermediate transfer member, and wherein among the plurality of monocolor image forming unit contained in the tandem image forming device at least two monocolor image forming unit each include a toner recycling device for conveying toner collected at the image carrier cleaning device to the developing device, the toner recycling device comprising a screw adapted to receive toner from the image carrier cleaning device, an axis of rotation of the screw extending about perpendicular to a direction of travel of the toner from the image carrier cleaning device to the developing device, and a conveying belt adapted to receive toner from the screw and to deliver toner to the developing device.

2. The image forming apparatus according to claim 1, wherein monocolor images formed by the respective monocolor image forming unit are synthesized via the intermediate transfer member to form a synthesized color image on the recording medium.

3. The image forming apparatus according to claim 2, wherein in the tandem image forming device the monocolor image forming unit located upstream-most in the rotary transport direction of the intermediate transfer member includes the toner recycling device.

4. The image forming apparatus according to claim 2, wherein among the plurality of monocolor image forming unit at least a black monocolor image forming unit includes the toner recycling device.

5. The image forming apparatus according to claim 2, wherein in the tandem image forming device a black monocolor image forming unit is located downstream-most in the rotary transport direction of the intermediate transfer member.

6. The image forming apparatus according to claim 1, wherein two monocolor image forming unit are arrayed along the rotary transport direction of the intermediate transfer member to form a two-color image on the recording medium by synthesizing via the intermediate transfer member two monocolor images formed at the two arrayed monocolor image forming unit.

7. The image forming apparatus according to claim 1, wherein the image carrier comprises a drum and the intermediate transfer member comprises a belt.

8. The image forming apparatus according to claim 1, wherein the image carrier and the intermediate transfer member both comprise respective belts.

9. The image forming apparatus according to claim 1, further comprising a process cartridge integrally attached to and detached from a body of the image forming apparatus, wherein the process cartridge includes at least the image carrier.

10. The image forming apparatus according to claim 1, wherein the image forming apparatus applies a developing bias voltage on the developing device to generate an alternative electric field at the time of development.

11. The image forming apparatus according to claim 1, wherein the image forming apparatus employs toner which contains a release agent.

12. The image forming apparatus according to claim 1, wherein the image forming apparatus employs toner with a roundness of 90 or more.

13. The image forming apparatus according to claim 1, wherein the image forming apparatus employs toner having a half-value width of 2.2 [fC/10 $\mu$m] or less in a distribution curve of (toner charge)/(toner particle diameter).

14. The image forming apparatus according to claim 1, wherein the intermediate transfer member includes an elastic layer.

15. The image forming apparatus according to claim 1, wherein the intermediate transfer member includes a toner adhesion reduction layer for reducing an adhesion of toner uniformly formed over a surface thereof.

16. The image forming apparatus according to claim 15, wherein the toner adhesion reduction layer is composed of zinc stearate.

17. The image forming apparatus according to claim 15, wherein the toner adhesion reduction layer is composed of fluororesin.

18. The image forming apparatus according to claim 15, wherein the toner adhesion reduction layer is composed of particles scraped off a block of bound particles using a brush and adhered to the intermediate transfer member.

19. The image forming apparatus, comprising monocolor image forming unit including a developing device and an image carrier cleaning device arranged around an image carrier, for transferring a toner image formed on the image carrier in the monocolor image forming unit once to an intermediate transfer member then transferring the toner image from the intermediate transfer member to a recording medium to form an image thereon, wherein a plurality of the monocolor image forming unit is arrayed along the rotary transport direction of the intermediate transfer member to configure a tandem image forming device for forming a multicolor image on the intermediate transfer member, and wherein among the plurality of monocolor image forming unit contained in the tandem image forming device at least two monocolor image forming unit each include a toner recycling device for conveying toner collected at the image carrier cleaning device to the developing device, the toner recycling device comprising a screw adapted to receive toner from the image carrier cleaning device, an axis of rotation of the screw extending about perpendicular to a direction of travel of the toner from the image carrier cleaning device to the developing device, and a conveying belt adapted to receive toner from the screw and to deliver toner to the developing device, and wherein the following relation is satisfied:

$$L_0/V_L > \rho_V \cdot \epsilon \cdot \epsilon_0$$

where $L_0$ denotes a distance in the rotary transport direction of the intermediate transfer member between a location of a charge given to a surface of the intermediate transfer member and a location of toner moved from the image carrier to the surface of the intermediate transfer member; $V_L$, $\rho_V$ and $\epsilon$ respectively denote a surface moving velocity, volume resistivity and relative permittivity of the intermediate transfer member; and $\epsilon_0$ denotes the vacuum permittivity.

20. The image forming apparatus according to claim 19, wherein the following relation is satisfied:

$$L_2/V_L > \rho_V \cdot \epsilon \cdot \epsilon_0$$

where $L_2$ denotes a distance of an image carrier located downstream-most among the image carriers in the rotary transport direction of the intermediate transfer member between a primary transfer location and a secondary transfer location, the primary transfer location being defined as a location on the intermediate transfer member to which the toner image on the image carrier to be transferred, the secondary transfer location being defined as a location on the recording medium to which the toner image on the intermediate transfer member to be transferred.

21. The image forming apparatus according to claim 19, wherein the following relation is satisfied:

$$L_3/V_L > \rho_V \cdot \epsilon \cdot \epsilon_0$$

where $L_3$ denotes a distance in the rotary transport direction of the intermediate transfer member between a secondary transfer location and an intermediate transfer member cleaning location, the secondary transfer location being defined as a location on the recording medium to which the toner image on the intermediate transfer member to be transferred, the intermediate transfer member cleaning location being defined as a location at which, after the transfer performed at the secondary transfer location, residual toner on the intermediate transfer member to be removed by an intermediate transfer member cleaning device.

22. The image forming apparatus according to claim 19, wherein the following relation is satisfied:

$$L_4/V_L > \rho_V \cdot \epsilon \cdot \epsilon_0$$

where $L_4$ denotes a distance of an image carrier located upstream-most among the image carriers in the rotary transport direction of the intermediate transfer member between a primary transfer location and an intermediate transfer member cleaning location, the primary transfer location being defined as a location on the intermediate transfer member to which the toner image on the image carrier to be transferred, the intermediate transfer member cleaning location being defined as a location at which, after the toner image on the intermediate transfer member transferred to the recording medium, residual toner on the intermediate transfer member to be removed by an intermediate transfer member cleaning device.

23. The image forming apparatus comprising monocolor image forming unit including a developing device and an image carrier cleaning device arranged around an image carrier, for transferring a toner image formed on the image carrier in the monocolor image forming unit once to an intermediate transfer member then transferring the toner image from the intermediate transfer member to a recording medium to form an image thereon, wherein a plurality of the monocolor image forming unit is arrayed along the rotary transport direction of the intermediate transfer member to configure a tandem image forming device for forming a multicolor image on the intermediate transfer member, and wherein among the plurality of monocolor image forming unit contained in the tandem image forming device at least two monocolor image forming unit each include a toner recycling device for conveying toner collected at the image carrier cleaning device to the developing device, the toner recycling device comprising a screw adapted to receive toner from the image carrier cleaning device, an axis of rotation of the screw extending about perpendicular to a direction of travel of the toner from the image carrier cleaning device to the developing device, and a conveying belt adapted to receive toner from the screw and to deliver toner to the developing device, and wherein the following relation is satisfied:

$$L_1/V_L > \rho_V \cdot \epsilon \cdot \epsilon_0$$

where $L_1$ denotes the shortest distance in the rotary transport direction of the intermediate transfer member among distances between adjacent primary transfer locations, the primary transfer location being defined as a location on the intermediate transfer member to which the toner image on the image carrier to be transferred; $V_L$, $\rho_V$ and $\epsilon$ respectively denote a surface moving velocity, volume resistivity and relative permittivity of the intermediate transfer member; and $\epsilon_0$ denotes the vacuum permittivity.

24. A monocolor image forming apparatus, comprising monocolor image forming unit including a developing device and an image carrier cleaning device arranged around an image carrier, for use in an image forming apparatus for transferring a toner image formed on the image carrier once to an intermediate transfer member then transferring the toner image from the intermediate transfer member to a recording medium to form an image thereon, wherein a plurality of the monocolor image forming unit is arrayed along the rotary transport direction of the intermediate transfer member to configure a tandem image forming device for forming a multicolor image on the intermediate transfer member, and wherein among the plurality of arrayed monocolor image forming unit at least two monocolor image forming unit each include a toner recycling device for conveying toner collected at the image carrier cleaning device to the developing device, the toner recycling device comprising a screw adapted to receive toner from the image carrier cleaning device, an axis of rotation of the screw extending about perpendicular to a direction of travel of the toner from the image carrier cleaning device to the developing device, and a conveying belt adapted to receive toner from the screw and to deliver toner to the developing device.

25. A toner recycling apparatus, for use in an image forming apparatus comprising monocolor image forming unit including a developing device and an image carrier cleaning device arranged around an image carrier for transferring a toner image formed on the image carrier in the monocolor image forming unit once to an intermediate transfer member then transferring the toner image from the intermediate transfer member to a recording medium to form an image thereon, wherein a plurality of the monocolor image forming unit is arrayed along the rotary transport direction of the intermediate transfer member to configure a tandem image forming device for forming a multicolor image on the intermediate transfer member, and wherein among the plurality of arrayed monocolor image forming unit at least two monocolor image forming unit each include the toner recycling apparatus for conveying toner collected at the image carrier cleaning device to the developing device, the toner recycling apparatus comprising a screw adapted to receive toner from the image carrier cleaning device, an axis of rotation of the screw extending about perpendicular to a direction of travel of the toner from the image carrier cleaning device to the developing device, and a conveying belt adapted to receive toner from the screw and to deliver toner to the developing device.

26. An image forming apparatus, comprising monocolor image forming unit including a developing device and an image carrier cleaning device arranged around an image carrier, for transferring a toner image formed on the image carrier in the monocolor image forming unit once to an intermediate transfer member then transferring the toner image from the intermediate transfer member to a recording medium to form an image thereon, wherein one monocolor image forming unit for forming a monochromic image on the intermediate transfer member is provided around the intermediate transfer member, and wherein the one monocolor image forming unit is provided with a toner recycling device for conveying toner collected at the image carrier cleaning device to the developing device, the toner recycling device comprising a screw adapted to receive toner from the image carrier cleaning device, an axis of rotation of the screw extending about perpendicular to a direction of travel of the toner from the image carrier cleaning device to the developing device, and a conveying belt adapted to receive toner from the screw and to deliver toner to the developing device.

27. The image forming apparatus according to claim 26, wherein the image carrier comprises a drum and the intermediate transfer member comprises a belt or drum.

28. The image forming apparatus according to claim 26, wherein the image carrier comprises a belt and the intermediate transfer member comprises a belt or drum.

29. The image forming apparatus according to claim 26, further comprising a process cartridge integrally attached to and detached from a body of the image forming apparatus, wherein the process cartridge includes at least the image carrier.

30. The image forming apparatus according to claim 26, wherein the image forming apparatus applies a developing bias voltage on the developing device to generate an alternative electric field at the time of development.

31. The image forming apparatus according to claim 26, wherein the image forming apparatus employs toner which contains a release agent.

32. The image forming apparatus according to claim 26, wherein the image forming apparatus employs toner with a roundness of 90 or more.

33. The image forming apparatus according to claim 26, wherein the image forming apparatus employs toner having a half-value width of 2.2 [fC/10 $\mu$m] or less in a distribution curve of (toner charge)/(toner particle diameter).

34. The image forming apparatus according to claim 26, wherein the intermediate transfer member includes an elastic layer.

35. The image forming apparatus according to claim 26, wherein the intermediate transfer member includes a toner adhesion reduction layer for reducing an adhesion of toner uniformly formed over a surface thereof.

36. The image forming apparatus according to claim 35, wherein the toner adhesion reduction layer is composed of zinc stearate.

37. The image forming apparatus according to claim 35, wherein the toner adhesion reduction layer is composed of fluororesin.

38. The image forming apparatus according to claim 35, wherein the toner adhesion reduction layer is composed of particles scraped off a block of bound particles using a brush and adhered to the intermediate transfer member.

39. A monocolor image forming apparatus, comprising monocolor image forming unit including a developing device and an image carrier cleaning device arranged around an image carrier, for use in an image forming apparatus for transferring a toner image formed on the image carrier once to an intermediate transfer member then transferring the toner image from the intermediate transfer member to a recording medium to form an image thereon, wherein one monocolor image forming unit for forming a monochromic image on the intermediate transfer member is provided around the intermediate transfer member, and wherein the one monocolor image forming unit is provided with a toner recycling device for conveying toner collected at the image carrier cleaning device to the developing device, the toner recycling device comprising a screw adapted to receive toner from the image carrier cleaning device, an axis of rotation of the screw extending about perpendicular to a direction of travel of the toner from the image carrier cleaning device to the developing device, and a conveying belt adapted to receive toner from the screw and to deliver toner to the developing device.

40. A toner recycling apparatus, for use in an image forming apparatus comprising monocolor image forming unit including a developing device and an image carrier cleaning device arranged around an image carrier for transferring a toner image formed on the image carrier in the monocolor image forming unit once to an intermediate transfer member then transferring the toner image from the intermediate transfer member to a recording medium to form an image thereon, wherein one monocolor image forming unit for forming a monochromic image on the intermediate transfer member is provided around the intermediate transfer member, and wherein the one monocolor image forming unit is provided with the toner recycling apparatus for conveying toner collected at the image carrier cleaning device to the developing device, the toner recycling apparatus comprising a screw adapted to receive toner from the image carrier cleaning device, an axis of rotation of the screw extending about perpendicular to a direction of travel of the toner from the image carrier cleaning device to the developing device, and a conveying belt adapted to receive toner from the screw and to deliver toner to the developing device.

41. An image forming apparatus comprising monocolor image forming unit including a developing device and an image carrier cleaning device arranged around an image carrier, for transferring a toner image formed on the image carrier in the monocolor image forming unit once to an intermediate transfer member then transferring the toner image from the intermediate transfer member to a recording medium to form an image thereon, wherein one monocolor image forming unit for forming a monochromic image on the intermediate transfer member is provided around the intermediate transfer member, and wherein the one monocolor image forming unit is provided with a toner recycling device for conveying toner collected at the image carrier cleaning device to the developing device, and wherein the following relation is satisfied:

$$L_0/V_L > \rho_V \cdot \epsilon \cdot \epsilon_0$$

where $L_0$ denotes a distance in the rotary transport direction of the intermediate transfer member between a location of a charge given to a surface of the intermediate transfer member and a location of toner moved from the image carrier to the surface of the intermediate transfer member; $V_L$, $\rho_V$ and $\epsilon$ respectively denote a surface moving velocity, volume resistivity and relative permittivity of the intermediate transfer member; and $\epsilon_0$ denotes the vacuum permittivity.

42. The image forming apparatus according to claim 41, wherein the following relation is satisfied:

$$L_2/V_L > \rho_V \cdot \epsilon \cdot \epsilon_0$$

where $L_2$ denotes a distance of an image carrier located downstream-most among image carriers in the rotary transport direction of the intermediate transfer member between a primary transfer location and a secondary transfer location, the primary transfer location being defined as a location on the intermediate transfer member to which the toner image on the image carrier to be transferred, the secondary transfer location being defined as a location on the recording medium to which the toner image on the intermediate transfer member to be transferred.

43. The image forming apparatus according to claim 41, wherein the following relation is satisfied:

$$L_3/V_L > \rho_V \cdot \epsilon \cdot \epsilon_0$$

where $L_3$ denotes a distance in the rotary transport direction of the intermediate transfer member between a secondary transfer location and an intermediate transfer member cleaning location, the secondary transfer location being defined as a location on the recording medium to which the toner image on the intermediate transfer member to be transferred, the intermediate transfer member cleaning location being defined as a location at which, after the transfer performed at the secondary transfer location, residual toner on the intermediate transfer member to be removed by an intermediate transfer member cleaning device.

44. The image forming apparatus according to claim 41, wherein the following relation is satisfied:

$$L_4/V_L > \rho_V \cdot \epsilon \cdot \epsilon_0$$

where $L_4$ denotes a distance of an image carrier located upstream-most among image carriers in the rotary transport direction of the intermediate transfer member between a primary transfer location and an intermediate transfer member cleaning location, the primary transfer location being defined as a location on the intermediate transfer member to which the toner image on the image carrier to be transferred, the intermediate transfer member cleaning location being defined as a location at which, after the toner image on the intermediate transfer member transferred to the recording medium, residual toner on the intermediate transfer member to be removed by an intermediate transfer member cleaning device.

45. An image forming apparatus comprising monocolor image forming unit including a developing device and an image carrier cleaning device arranged around an image carrier for transferring a toner image formed on the image carrier in the monocolor image forming unit once to an intermediate transfer member then transferring the toner image from the intermediate transfer member to a recording medium to form an image thereon, wherein a plurality of the monocolor image forming unit is arrayed along the rotary transport direction of the intermediate transfer member to configure a tandem image forming device for forming a multicolor image on the intermediate transfer member, and wherein among the plurality of arrayed monocolor image forming unit at least two monocolor image forming unit each include the toner recycling apparatus for conveying toner collected at the image carrier cleaning device to the developing device, and wherein the following relation is satisfied:

$$L_1/V_L > \rho_V \cdot \epsilon \cdot \epsilon_0$$

where $L_1$ denotes the shortest distance in the rotary transport direction of the intermediate transfer member among distances between adjacent primary transfer locations, the primary transfer location being defined as a location on the intermediate transfer member to which the toner image on the image carrier to be transferred; $V_L$, $\rho_V$ and $\epsilon$ respectively denote a surface moving velocity, volume resistivity and relative permittivity of the intermediate transfer member; and $\epsilon_0$ denotes the vacuum permittivity.

46. An intermediate transfer member for use in a xerography apparatus for transferring a toner image formed on an image carrier once to a surface of the intermediate transfer member then secondarily transferring the toner image from the intermediate transfer member to a sheet, wherein a single toner adhesion reduction layer for reducing an adhesion of toner is uniformly formed over the surface.

47. The intermediate transfer member according to claim 46, wherein the toner adhesion reduction layer is composed of zinc stearate.

48. The intermediate transfer member according to claim 46, wherein the toner adhesion reduction layer is composed of fluororesin.

49. An image forming apparatus, comprising the intermediate transfer member for use in a xerography apparatus for transferring a toner image formed on an image carrier once to a surface of the intermediate transfer member then secondarily transferring the toner image from the intermediate transfer member to a sheet, wherein a single toner adhesion reduction layer for reducing an adhesion of toner is uniformly formed over the surface.

50. The image forming apparatus according to claim 49, wherein the toner adhesion reduction layer is composed of zinc stearate.

51. The image forming apparatus according to claim 49, wherein the toner adhesion reduction layer is composed of fluororesin.

52. The image forming apparatus according to claim 49, wherein the toner adhesion reduction layer is composed of particles adhered on the intermediate transfer member when a block of bound particles is pressed against the intermediate transfer member while rotating the intermediate transfer member.

53. The image forming apparatus according to claim 52, wherein the block of bound particles is pressed with a controllable force.

54. An image forming apparatus comprising the intermediate transfer member for use in a xerography apparatus for transferring a toner image formed on an image carrier once to a surface of the intermediate transfer member then secondarily transferring the toner image from the intermediate transfer member to a sheet, wherein a toner adhesion reduction layer for reducing an adhesion of toner is uniformly formed over the surface, and wherein the following relation is satisfied:

$$L_0/V_L > \rho_V \cdot \epsilon \cdot \epsilon_0$$

where $L_0$ denotes a distance in the rotary transport direction of the intermediate transfer member between a location of a charge given to a surface of the intermediate transfer member and a location of toner moved from the image carrier to the surface of the intermediate transfer member; $V_L$, $\rho_V$ and $\epsilon$ respectively denote a surface moving velocity, volume resistivity and relative permittivity of the intermediate transfer member; and $\epsilon_0$ denotes the vacuum permittivity.

55. The image forming apparatus according to claim 54, further comprising a plurality of intermediate transfer members, wherein the following relation is satisfied:

$$L_1/V_L > \rho_V \cdot \epsilon \cdot \epsilon_0$$

where $L_1$ denotes the shortest distance in the rotary transport direction of the intermediate transfer member among distances between adjacent primary transfer locations, the primary transfer location being defined as a location on the intermediate transfer member to which the toner image on the image carrier to be transferred; $V_L$, $\rho_V$ and $\epsilon$ respectively denote a surface moving velocity, volume resistivity and relative permittivity of the intermediate transfer member; and $\epsilon_0$ denotes the vacuum permittivity.

56. The image forming apparatus according to claim 54, wherein the following relation is satisfied:

$$L_2/V_L > \rho_V \cdot \epsilon \cdot \epsilon_0$$

where $L_2$ denotes a distance of an image carrier located downstream-most among image carriers in the rotary transport direction of the intermediate transfer member between a primary transfer location and a secondary transfer location, the primary transfer location being defined as a location on the intermediate transfer member to which the toner image on the image carrier to be transferred, the secondary transfer location being defined as a location on the recording medium to which the toner image on the intermediate transfer member to be transferred.

57. The image forming apparatus according to claim 54, wherein the following relation is satisfied:

$$L_3/V_L > \rho_V \cdot \epsilon \cdot \epsilon_0$$

where $L_3$ denotes a distance in the rotary transport direction of the intermediate transfer member between a secondary transfer location and an intermediate transfer member cleaning location, the secondary transfer location being defined as a location on the recording medium to which the toner image on the intermediate transfer member to be transferred, the intermediate transfer member cleaning location being defined as a location at which, after the transfer performed at the secondary transfer location, residual toner on the intermediate transfer member to be removed by an intermediate transfer member cleaning device.

58. The image forming apparatus according to claim 54, wherein the following relation is satisfied:

$$L_4/V_L > \rho_V \cdot \epsilon \cdot \epsilon_0$$

where $L_4$ denotes a distance of an image carrier located upstream-most among image carriers in the rotary transport direction of the intermediate transfer member between a primary transfer location and an intermediate transfer member cleaning location, the primary transfer location being defined as a location on the intermediate transfer member to which the toner image on the image carrier to be transferred, the intermediate transfer member cleaning location being defined as a location at which, after the toner image on the intermediate transfer member transferred to the recording medium, residual toner on the intermediate transfer member to be removed by an intermediate transfer member cleaning device.

* * * * *